US007310488B2

(12) United States Patent
Kitamura

(10) Patent No.: US 7,310,488 B2
(45) Date of Patent: Dec. 18, 2007

(54) BELT DEVICE AND IMAGE FORMING APPARATUS

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 251 days.

(21) Appl. No.: 10/962,876

(22) Filed: Oct. 12, 2004

(65) Prior Publication Data

US 2005/0095029 A1 May 5, 2005

(30) Foreign Application Priority Data

Nov. 4, 2003 (JP) ..... 2003-374048

(51) Int. Cl.
*G03G 15/08* (2006.01)

(52) U.S. Cl. ..... 399/102; 399/105; 399/162; 399/303; 399/312

(58) Field of Classification Search ..... 399/102, 399/105, 162, 164, 303, 312, 313, 98, 99; 198/750.3
See application file for complete search history.

(56) References Cited

U.S. PATENT DOCUMENTS 5,179,412 A * 1/1993 Yamada et al. ..... 399/168
6,052,548 A * 4/2000 Yamamoto ..... 399/116
6,510,941 B2 * 1/2003 Schermutzki et al. .... 198/836.1

FOREIGN PATENT DOCUMENTS

JP 09-258568 A 10/1997

* cited by examiner

*Primary Examiner*—David M. Gray
*Assistant Examiner*—Laura K Roth
(74) *Attorney, Agent, or Firm*—Akin Gump Strauss Hauer & Feld LLP

(57) ABSTRACT

A belt device includes an endless belt, a plurality of rollers around which the endless belt is wound, and a foreign material entry preventing member disposed on at least one side of the endless belt in the width direction. The foreign material entry preventing member prevents the entry of the foreign material into a region surrounded by the endless belt.

15 Claims, 18 Drawing Sheets

BELT DEVICE AND IMAGE FORMING APPARATUS

BACKGROUND OF THE INVENTION

This invention relates to a belt device having an endless belt wound around a plurality of rollers, and an image forming apparatus (such as a copier, a facsimile or a printer) that uses the belt device.

Conventionally, an image forming apparatus uses an endless belt as a conveyor belt that conveys a recording medium or a transfer belt that bears a toner image. FIG. 17 shows an example of the conventional image forming apparatus using the endless belt. The image forming apparatus shown in FIG. 17 has a belt device including a drive roller 102, a tension roller 104 and an endless belt 101 wound around the drive roller 102 and the tension roller 104. Four transfer rollers 108 are provided between the drive roller 102 and the tension roller 104. On the upper sides of the transfer rollers 108 in FIG. 17, toner image forming portions 107 are disposed in opposition to the transfer rollers 108 via the endless belt 101. Each toner image forming portion 107 includes a photosensitive body 105, a charging device 106, an exposing device 109 and a developing device 111. The charging device 106 uniformly charges the surface of the photosensitive body 105. The exposing device 109 exposes the surface of the photosensitive body 105 to form a latent image. The developing device 111 causes the toner to adhere to the latent image on the photosensitive body 105. A voltage with polarity opposite to the electrical charge of the toner is applied to the transfer roller 108.

The recording medium P is supplied by a medium supply portion 117 one by one. An alignment portion 118 corrects the skew of the recording medium P or the like, and feeds the recording medium P to the endless belt 101. By the rotation of the drive roller 102, the endless belt 101 moves (circulates) as shown by an arrow I, and feeds the recording medium P. The toner image formed on each photosensitive roller 105 is transferred to the recording medium P due to the bias voltage of the transfer roller 108. The recording medium P is further fed to a fixing portion 119 disposed on the downstream side of the toner image forming portions 107, and heated and pressed so that the toner image is fixed to the recording medium P.

FIG. 18 is a sectional view taken along line XVIII-XVIII in FIG. 17. FIG. 19 is a perspective view of the belt device. In FIG. 18, the photosensitive body 5 is shown by a dashed line, and the charging device 106 (FIG. 17) is omitted. A cleaning blade 112 is provided in opposition to the photosensitive body 105, for removing the residual toner from the photosensitive body 105. Seals 114 and 115 are provided for sealing the gap between the cleaning blade 112 and an accommodating portion 116. However, the seals 114 and 115 can not completely prevent the leakage of the toner, and therefore the toner may leak out of the accommodating portion 116.

The above described drive roller 102 and the tension roller 104 (FIG. 19) are supported by a common belt frame 103, but there is a gap J between the belt frame 103 and the endless belt 101. If the toner leaks out of the accommodating portion 116, the toner may falls from the accommodating portion 116 and may enter into the inner region of the endless belt 101 through the gap J between the endless belt 101 and the belt frame 103 as shown by an arrow K. In such a case, the toner may directly adhere to the inner circumferential surface of the endless belt 101, or may indirectly adhere to the inner circumferential surface of the endless belt 101 via the transfer roller 108 having a voltage with polarity opposite to the toner. Such a toner may be caught between the endless belt 101 and the drive roller 102 (FIG. 19), and may decrease the friction force between the endless belt 101 and the drive roller 102. Thus, there may be a difference between the rotational speed of the photosensitive body 105 and the moving speed of the endless belt 101. As a result, the transferring positions on the recording medium P at the toner image forming portions 107 may shift from each other, and therefore the image quality may be degraded.

In order to solve this problem, Japanese Laid-open patent publication HEI 9-258568 (Page 2, FIG. 1) proposes an arrangement having a cleaning blade mounted on the belt frame, which scraps the toner from the inner circumferential surface of the endless belt.

However, even if the cleaning blade is mounted on the belt frame, the scraped toner remains in the inner region surrounded by the endless roller. Therefore, the scraped toner may again adhere to the inner circumferential surface of the endless belt, and may be caught between the endless belt and the drive roller. As a result, the degradation of the image quality can not be prevented.

SUMMARY OF THE INVENTION

An object of the present invention is to provide a belt device and an image forming apparatus capable of preventing foreign material from adhering to an inner circumferential surface of an endless belt.

According to the invention, there is provided a belt device including an endless belt, a plurality of rollers around which the endless belt is wound, and a foreign material entry preventing member disposed on at least one side of the endless belt in the width direction of the endless belt. The foreign material entry preventing member prevents the entry of foreign material into a region surrounded by the endless belt.

With such an arrangement, it becomes possible to prevent the foreign material from entering into the region surrounded by the endless belt, and therefore it becomes possible to prevent the foreign material from adhering to the inner circumferential surface of the endless belt. Thus, it becomes possible to prevent the foreign material from being caught between the endless belt and the roller, with the result that the decrease in the friction force can be prevented. Accordingly, the moving speed of the endless belt can be kept constant. Further, in the case where the belt device is used in the image forming apparatus, it becomes possible to prevent the degradation of the image quality caused by the shifting of the transferring position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Embodiments of the present invention will be described with reference to the attached drawings.

First Embodiment

Figure 1:
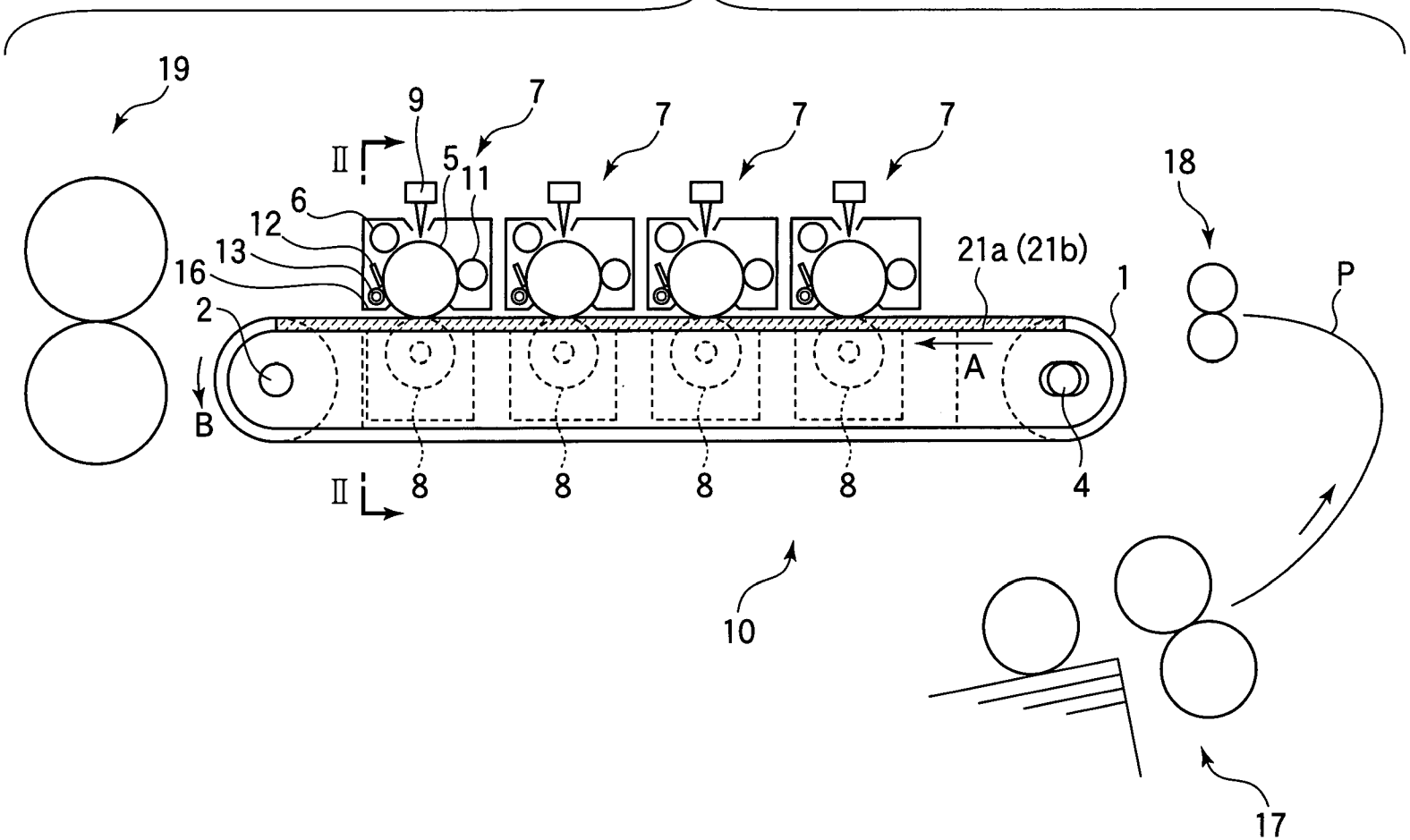
FIG. 1 shows the basic structure of an image forming apparatus including a belt device according to the first embodiment of the present invention.
Figure 2:
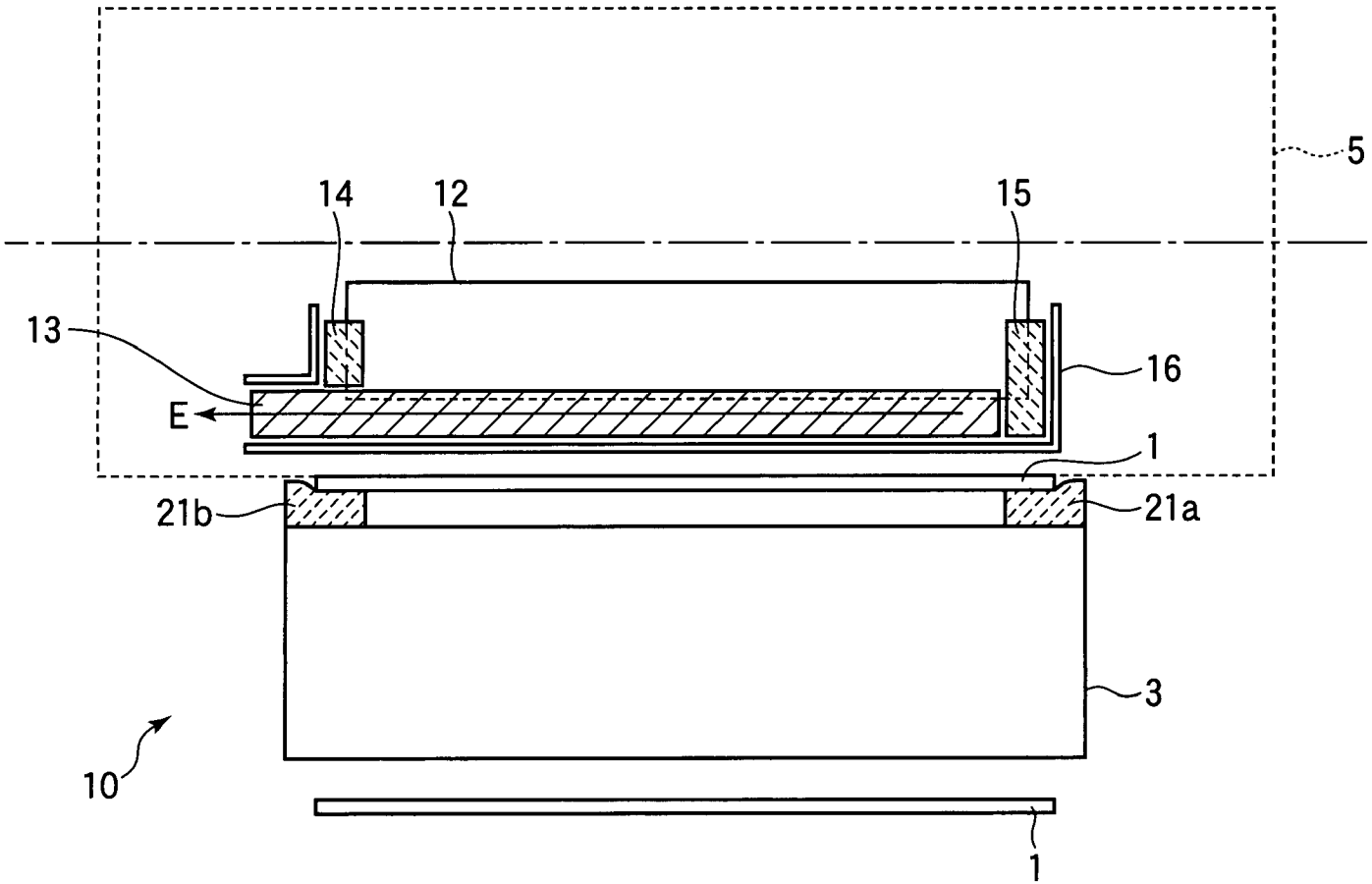
FIG. 2 is a sectional view of the belt device according to the first embodiment taken along line II-II in FIG. 1.

FIG. 1 shows a basic structure of an image forming apparatus using a belt device 10 according to the first embodiment of the present invention. FIG. 2 is a sectional view taken along line II-II in FIG. 1. The image forming apparatus is configured to form an image by electrophotography, and includes a belt device 10. The belt device 10 includes a drive roller 2, a tension roller 4 and an endless belt 1 wound around the drive roller 2 and the tension roller 4. The drive roller 2 is driven by a not shown motor and rotates counterclockwise shown by an arrow B in FIG. 1 so that the endless belt 1 moves (circulates) as shown by an arrow A. The tension roller 4 is urged in a direction away from the drive roller 2, and applies a tension to the endless belt 1. Four transfer rollers 8 are disposed between the drive roller 2 and the tension roller 4. Hereinafter, the term "front" is used to mean the drive roller 2 side of the belt device 10, and the term "rear" is used to mean the tension roller 4 side of the belt device 10.

On the upper sides of the four transfer rollers 8, four toner image forming portions 7 are provided in opposition to the transfer rollers 8 via the endless belt 1. Each toner image forming portion 7 includes a cylindrical photosensitive body 5 that rotates clockwise in FIG. 1. Along the rotational direction of the photosensitive body 5, a charging device 6 that uniformly charges the surface of the photosensitive body 5, an exposing device 9 that emits the light to the surface of the photosensitive body 5 to form a latent image thereon, a developing device 11 that causes a toner to adhere to the latent image on the photosensitive body 5 to form a visible image (a toner image). A voltage with polarity opposite to the toner on the photosensitive body 5 is applied to the transfer roller 8.

A medium supply portion 17 is disposed on the lower side of the belt device 10 in FIG. 1. The medium supply portion 17 supplies the recording medium P one by one to a feeding path. An alignment portion 18 is disposed on a feeding path between the medium supply portion 17 and the belt device 10. The alignment portion 18 corrects the skew of the recording medium P and feeds the recording medium P to the belt device 10. A fixing device 19 is provided on the downstream side (i.e., the left side in FIG. 1) of the belt device 10, for fixing the toner image to the recording medium P.

Each toner image forming portion 7 further includes a cleaning blade 12 for removing the residual toner that remains on the photosensitive body 5. As shown in FIG. 2, the cleaning blade 12 projects toward the photosensitive body 5 through an opening of an accommodating portion 16 in which a waste toner is accommodated. The accommodating portion 16 is provided with seals 14 and 15 for sealing gaps on both ends of the cleaning blade 12. In the accommodating portion 16, a conveying mechanism 13 (for example, a screw-type conveyer) conveys the waste toner in the direction E to a not-shown toner collecting portion. When the amount of the toner in the toner collecting portion reaches a predetermined amount, a not shown indicator displays a message indicating that the toner collecting portion needs to be replaced.

Figure 3:
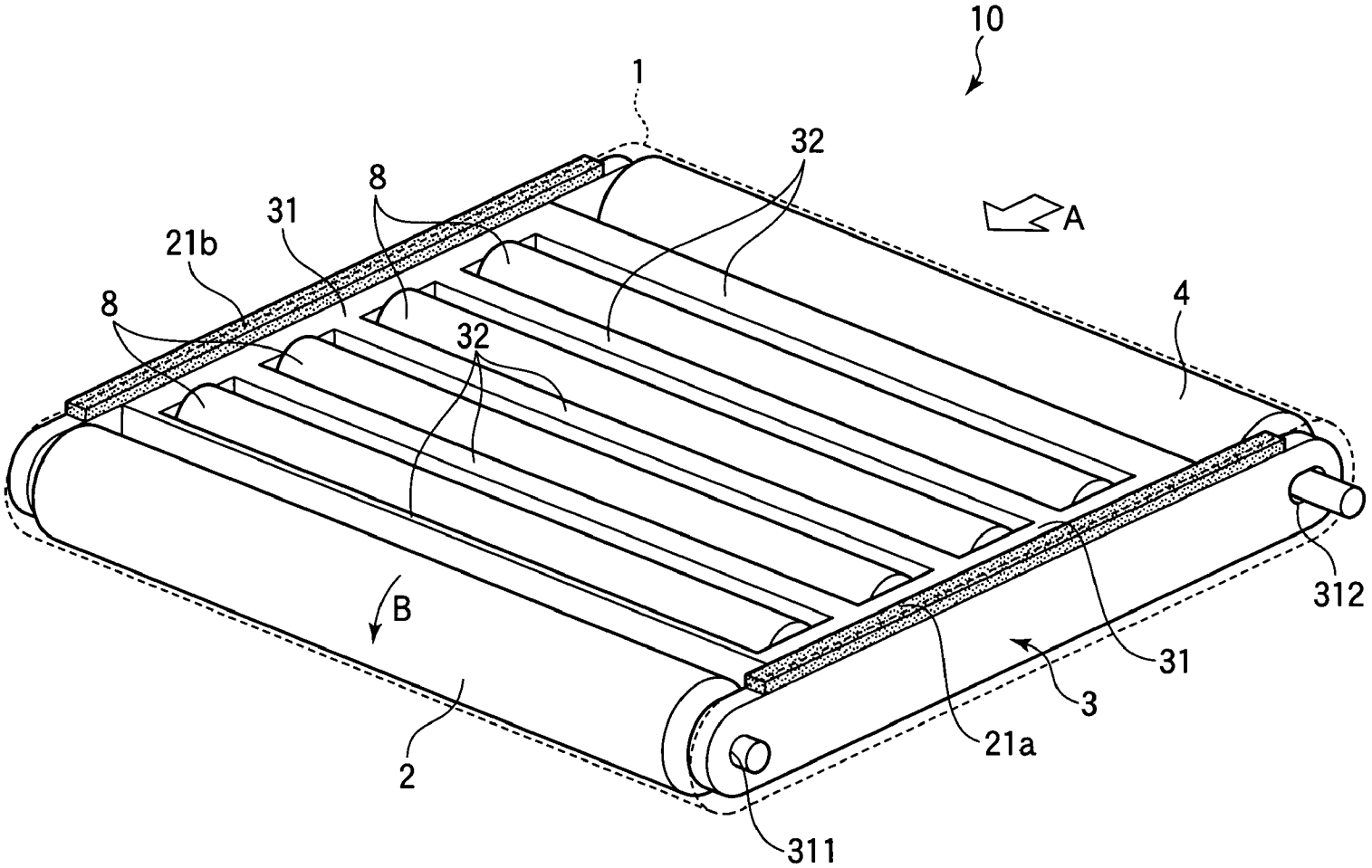
FIG. 3 is a perspective view of the belt device according to the first embodiment of the present invention.
Figure 4:
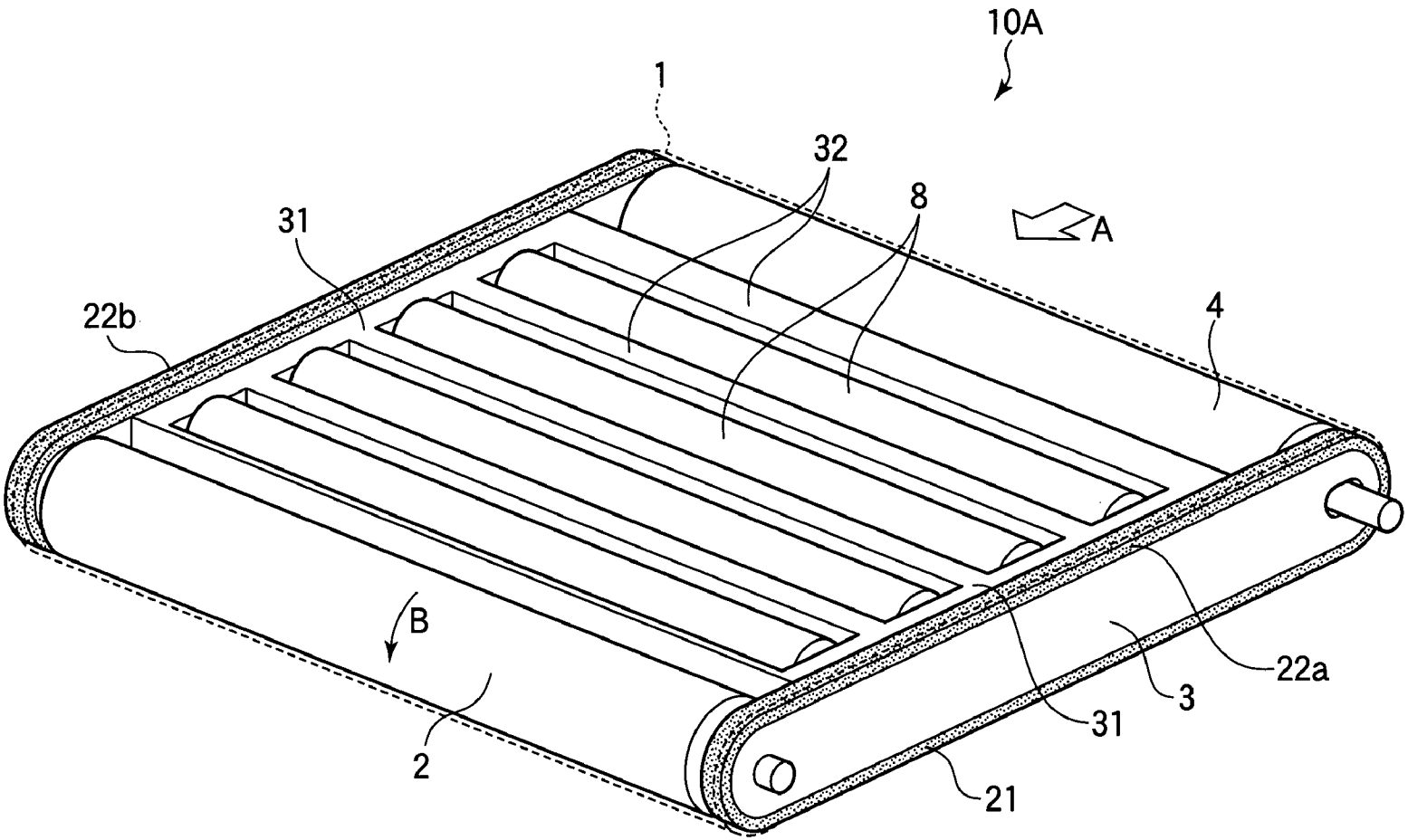
FIG. 4 is a perspective view of a belt device according to the second embodiment of the present invention.

FIG. 3 is a perspective view of the belt device 10 according to the first embodiment. In the belt device 10, the drive roller 2, the tension roller 4 and the transfer rollers 8 are rotatably supported by a common belt frame 3. The drive roller 2 includes, for example, a metal roller and a rubber surface layer formed on the surface of the metal roller. It is also possible to form a coating layer including ceramic powders instead of the rubber surface layer. A high friction force is obtained between the drive roller 2 and the endless belt 1. The tension roller 4 is formed by, for example, extruding of aluminum and cutting and machining the surface of the extruded aluminum. The width of the endless belt 1 is wider than the lengths of roller portions (i.e., portions except support shafts) of the drive roller 2 and the tension roller 4.

The belt frame 3 includes two extending portions 31 that extend in the front-rear direction. The extending portions 31 are disposed on both sides of the endless belt 1 in the width direction. Five partitions 32 divide a space between two extending portions 31 into sections for the driving roller 2, the tension roller 4 and the four transfer rollers 8. The extending portions 31 project frontward from the frontmost partition 32, and the frontward projecting portions of the extending portions 31 have through holes 311 for supporting the support shafts of the drive roller 2. The extending portions 31 project rearward from the rearmost partition 32, and the rearward projecting portions of the extending portions 31 have through holes 312 for supporting the support shafts of the tension roller 4.

Seal members 21*a* and 21*b* (i.e., foreign material entry preventing members) are fixed to the upper surface of the extending portions 31 of the belt frame 3. The seal members 21*a* and 21*b* are made of resilient member such as urethane foam. The seal members 21*a* and 21*b* extend along the upper surface of the extending portion 31 from the vicinity of the drive roller 2 to the vicinity of the tension roller 4. As shown in FIG. 2, both sides of the endless belt 1 in the width direction contact the upper surfaces of the seal members 21*a* and 21*b*, with the result that the seal members 21*a* and 21*b* seal between the upper surface of the belt frame 3 and the endless belt 1.

The operation of the image forming apparatus will be described. The recording medium P is supplied from the medium supply portion 17. The alignment portion 18 corrects the skew of the recording medium P and feeds the recording medium P to the belt device 10. In the belt device 10, the endless belt 1 moves (circulates) as shown by an arrow A by the rotation of the drive roller 2, so that the recording medium P on the endless belt 1 passes through the respective toner image forming portions 7. In each toner image forming portion 7, the toner image of each color is transferred from the photosensitive body 5 to the recording medium P. The recording medium P, to which the toner image of each color has been transferred, is fed to the fixing device 19 on the downstream side of the belt device 10. In the fixing device 19, the recording medium P is pressed and heated, so that the toner image is fixed to the recording medium. The recording medium P, to which the toner image has been fixed, is ejected through a not shown eject port.

In the above described operation of the image forming apparatus, the endless belt 1 moves (circulates) in sliding contact with the seal members 21*a* and 21*b*. Even if the toner falls from the accommodating portion 16, the entry of the toner into the inner region surrounded by the endless belt 1 can be prevented, because the seal members 21*a* and 21*b* seal between the endless belt 1 and the belt frame 3. Thus, it is possible to prevent the toner from adhering to the inner circumferential surface of the endless belt 1, and therefore it is possible to prevent the toner from being caught between the endless belt 1 and the drive roller 2. As a result, the decrease in the friction force between the endless belt 1 and the drive roller 2 is prevented, and therefore the moving speed of the endless belt 1 can be kept constant. Accordingly, it is possible to prevent the shifting of the transferring positions in the toner image forming portions 7, and therefore it is possible to prevent the degradation of the image quality.

As described above, according to the belt device of the first embodiment, the seal members 21*a* and 21*b* are configured to seal between the endless belt 1 and the belt frame 3, and therefore the entry of the toner into the inner region of the endless belt 1 can be prevented. Thus, it becomes possible to prevent the adhesion of the toner to the inner circumferential surface of the endless belt 1 and to prevent the decrease in the friction force between the endless belt 1 and the driving roller 2. As a result, high image quality can be maintained for a long time. Moreover, the seal members 21*a* and 21*b* are fixed to the belt frame 3 and contact the inner circumferential surface of the endless belt 1, and therefore the prevention of the entry of the toner into the inner region of the endless belt 1 can be accomplished with a simple structure. Additionally, the seal members 21*a* and 21*b* are made of resilient material, and therefore it is possible to prevent the entry of the toner even when a flare of the endless belt 1 (i.e., a deformation in which sides of the endless belt 1 are broadened) occurs.

In the above described first embodiment, the seal members 21*a* and 21*b* are provided on the upper surface of the belt frame 3. However, it is possible to provide the same seal members 21*a* and 21*b* on the lower surface of the belt frame 3. With such an arrangement, it is ensured that the entry of the toner into the inner region of the endless belt 1 can be prevented.

Further, in the first embodiment, the seal members 21*a* and 21*b* are provided on both sides of the endless belt 1 in the width direction. However, if the toner falls on only one side of the endless belt 1 in the width direction, it is possible to provide one seal member on one side of the endless belt 1.

Furthermore, the seal members 21*a* and 21*b* are not necessarily extend from the vicinity of the driving roller 2 to the vicinity of the tension roller 4. The seal members 21*a* and 21*b* can be appropriately arranged in accordance with the condition of the falling of the toner.

Second Embodiment

Figure 5:
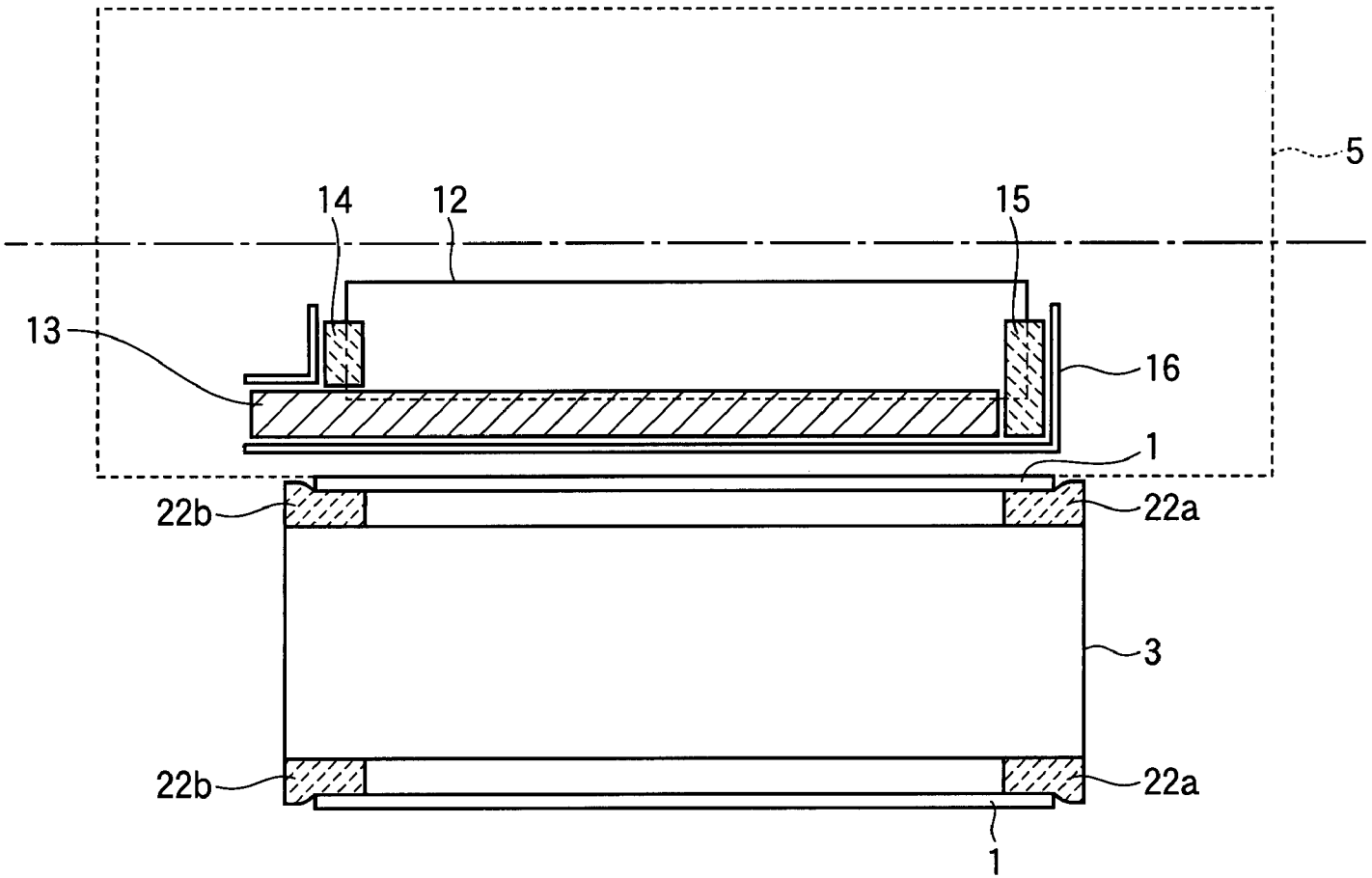
FIG. 5 is a sectional view of the belt device according to the second embodiment of the present invention.

FIG. 2 is a perspective view of a belt device 10A according to the second embodiment of the present invention. FIG. 5 is a sectional view of the image forming apparatus according to the second embodiment, corresponding to the sectional view taken along line II-II of FIG. 1. The difference between the second embodiment and the first embodiment is in the structure of the seal members. The other elements in the second embodiment are the same as those in the first embodiment. The belt device 10A of the second embodiment can be used in the image forming apparatus (FIG. 1) described in the first embodiment.

Each of the seal members 22*a* and 22*b* of the second embodiment is in the shape of an endless belt, and contacts the inner circumferential surface of the endless belt 1 over the whole circumference of the endless belt 1. The seal members 22*a* and 22*b* are made of resilient material such as urethane foam. The seal members 22*a* and 22*b* are fixed to and wound around the outer circumferential surfaces of the extending portions 31. As shown in FIG. 5, both sides of the endless belt 1 in the width direction contact the outer circumferential surfaces of the seal members 22*a* and 22*b*. As a result, the seal members 22*a* and 22*b* seal between the endless belt 1 and the belt frame 3 over the whole circumference of the endless belt 1.

When the drive roller 2 rotates, the endless belt 1 moves (circulates) in sliding contact with the seal members 22*a* and 22*b* over the whole circumference of the endless belt 1. Even if the toner falls from the toner accommodating portion 16, it is ensured that the entry of the toner into the inner region of the endless belt 1 is prevented, because the seal members 21*a* and 21*b* seal between the endless belt 1 and the belt frame 3 over the whole circumference of the endless belt 1.

In the second embodiment, the seal members 22*a* and 22*b* seal between the endless belt 1 and the belt frame 3 over the whole circumference of the endless belt 1, and therefore it is possible to prevent the entry of the toner (into the inner region of the endless belt 1) in all directions. Thus, it is ensured that the adhesion of the toner to the endless belt 1 can be prevented, and therefore the decrease in the friction force between the endless belt 1 and the drive roller 2 can be prevented. As a result, it is ensured that the degradation of the image quality can be prevented.

In the second embodiment, the seal members 22*a* and 22*b* are disposed on both sides of the endless belt 1 in the width direction. However, if the toner falls on only one side of the endless belt 1 in the width direction, it is possible to provide one seal member on one side of the endless belt 1.

Third Embodiment

Figure 6:
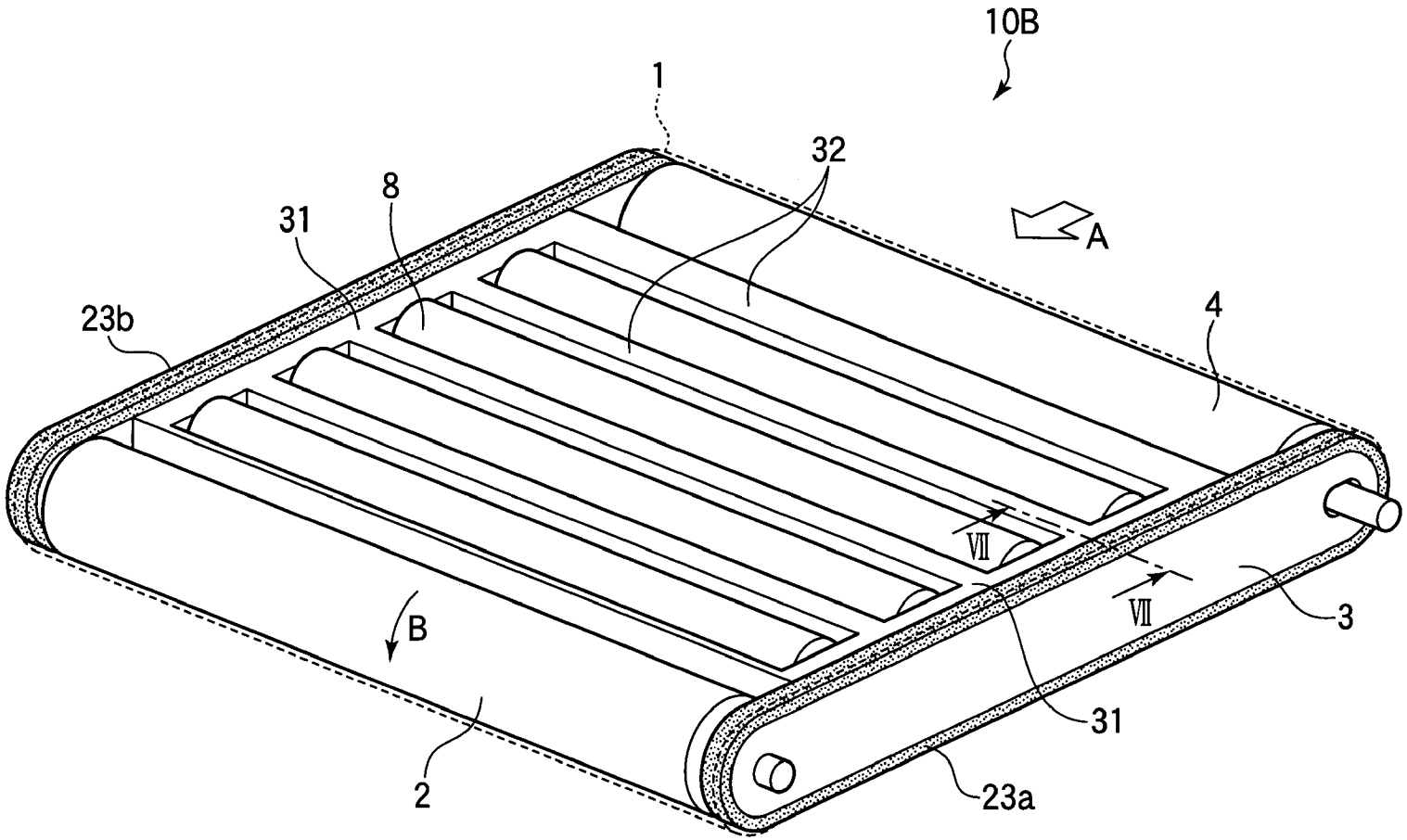
FIG. 6 is a perspective view of a belt device according to the third embodiment of the present invention.
Figure 7:
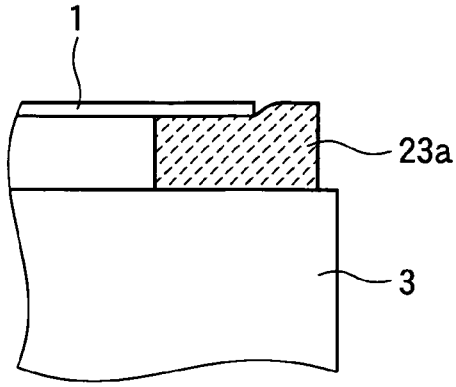
FIG. 7 is a sectional view of the belt device according to the third embodiment taken along line VII-VII in FIG. 6.
Figure 8A:
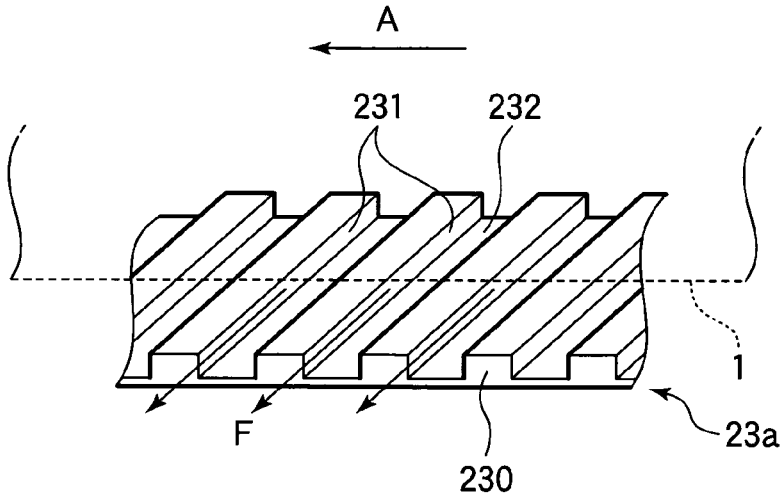
FIGS. 8A and 8B are enlarged perspective views of the belt device according to the third embodiment of the present invention.

FIG. 6 is a perspective view of the belt device 10B according to the third embodiment of the present invention. FIG. 7 is a sectional view taken along line VII-VII in FIG. 6. FIG. 8A is a perspective enlarged view of the outer circumferential surface of the seal member of the belt device 10B. The difference between the third embodiment and the second embodiment is in the structure of the seal members. The other elements in the third embodiment are the same as those in the second embodiment. The belt device 10B of the third embodiment is used in the image forming apparatus (FIG. 1) described in the first embodiment.

As shown in FIGS. 6 and 7, the seal members 23*a* and 23*b* of the third embodiment seal between the endless belt 1 and the belt frame 3 over the whole circumference of the endless belt 1, as was described in the second embodiment. The seal members 23*a* and 23*b* are made of resilient material such as NBR (nitrile-butadiene rubber). As shown in FIG. 8A, the seal members 23*a* and 23*b* (the seal member 23*b* is omitted in FIG. 8A) have ribs 230 on surfaces facing the endless belt 1. The ribs 230 are evenly spaced over the whole circumference of each of the seal members 23*a* and 23*b*. Each rib 230 has a rectangular cross section, and extends in a direction inclined by a predetermined angle with respect to the longitudinal direction of the seal members 23*a* and 23*b* (i.e., the moving direction A of the endless belt 1). Grooves 232 are formed between the adjacent ribs 230, and each groove 232 has a rectangular cross section. The upper surface of the rib 230 contacts the inner circumferential surface of the moving endless belt 1, and rear end surfaces 231 of the ribs 231 (i.e., front end surfaces of the grooves 232) scrapes the toner from the endless belt 1.

The extending direction of each rib 230 (i.e., the extending direction of each groove 231) is so inclined that the outer side of the rib 230 in the width direction of the endless belt 1 positions more to the front in the feeding direction A than the inner side of the rib 230. With such an inclination, when the toner is going to move in the direction A due to the friction of the endless belt 1 or the like, the toner abuts against the rear end surfaces 231 of the ribs 231, guided along the grooves 232, and ejected outward in the width direction of the endless belt 1 as shown by an arrow F. The angle between the extending direction of the rib 230 and the moving direction A of the endless belt 1 is preferably 45 degrees. However, if the angle ranges from 30 to 60 degrees, the toner can be efficiently ejected. Although the seal member 23*b* is omitted in FIG. 8A, the seal member 23*b* has the same ribs as the ribs 230 of the seal member 23*a*. The rib 230 of the seal member 23*b* and the rib 230 of the seal member 23*a* are symmetrical to each other with respect to a center line (extending in the front-rear direction) of the endless belt 1 so that the toner is ejected outward in the width direction.

In the third embodiment, in addition to the advantages of the second embodiment, the toner adhering to the inner circumferential surface of the endless belt 1 can be ejected outward in the width direction of the endless belt 1. Therefore, even if the toner adheres to the inner circumferential surface of the endless belt 1 because of deformation or defect of the seal members 23*a* and 23*b*, the toner can be immediately ejected. Accordingly, the decrease in the friction force between the drive roller 2 and the endless belt 1 due to the entry of the toner therein can be prevented. As a result, it is possible to prevent the degradation of the image quality due to the shifting of the transferring positions.

Moreover, the toner is ejected by the ribs 230 (the grooves 232) formed on the seal members 23*a* and 23*b*, and therefore the continuous ejection of the toner can be accomplished by a simple structure.

In the third embodiment, the seal members 23*a* and 23*b* are disposed on both sides of the endless belt 1 in the width direction. However, if the toner falls on only one side of the endless belt 1 in the width direction, it is possible to provide one seal member on one side of the endless belt 1.

Figure 8B:
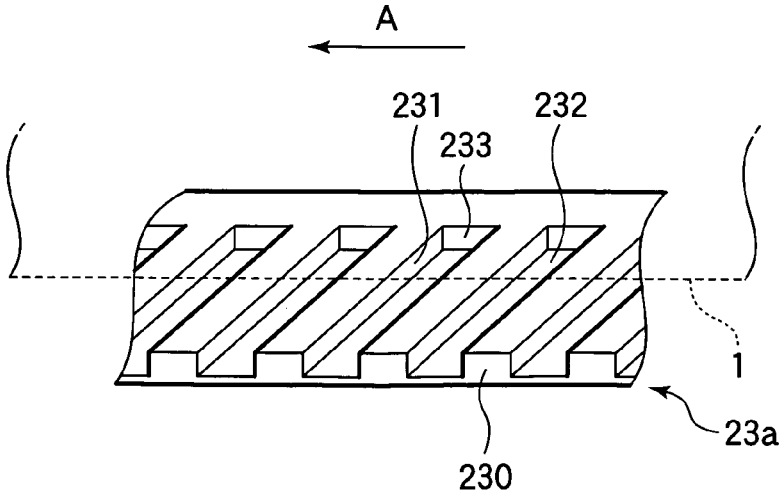

FIG. 8B shows an alternative arrangement of the seal member. In the alternative arrangement shown in FIG. 8B, the grooves 232 of the seal member 23*a* do not reach the inner edge of the seal member 23*a*. In other words, the grooves 232 have inner end surfaces 233. Although the seal member 23*b* is omitted in FIG. 8B, the grooves 232 of the seal member 23*b* do not reach the inner edge of the seal member 23*b*. With such an arrangement, it is possible to prevent the toner in the grooves 232 of the seal member 23*a* or 23*b* from moving inwardly and entering into the inner region of the endless belt 1.

Fourth Embodiment

Figure 9:
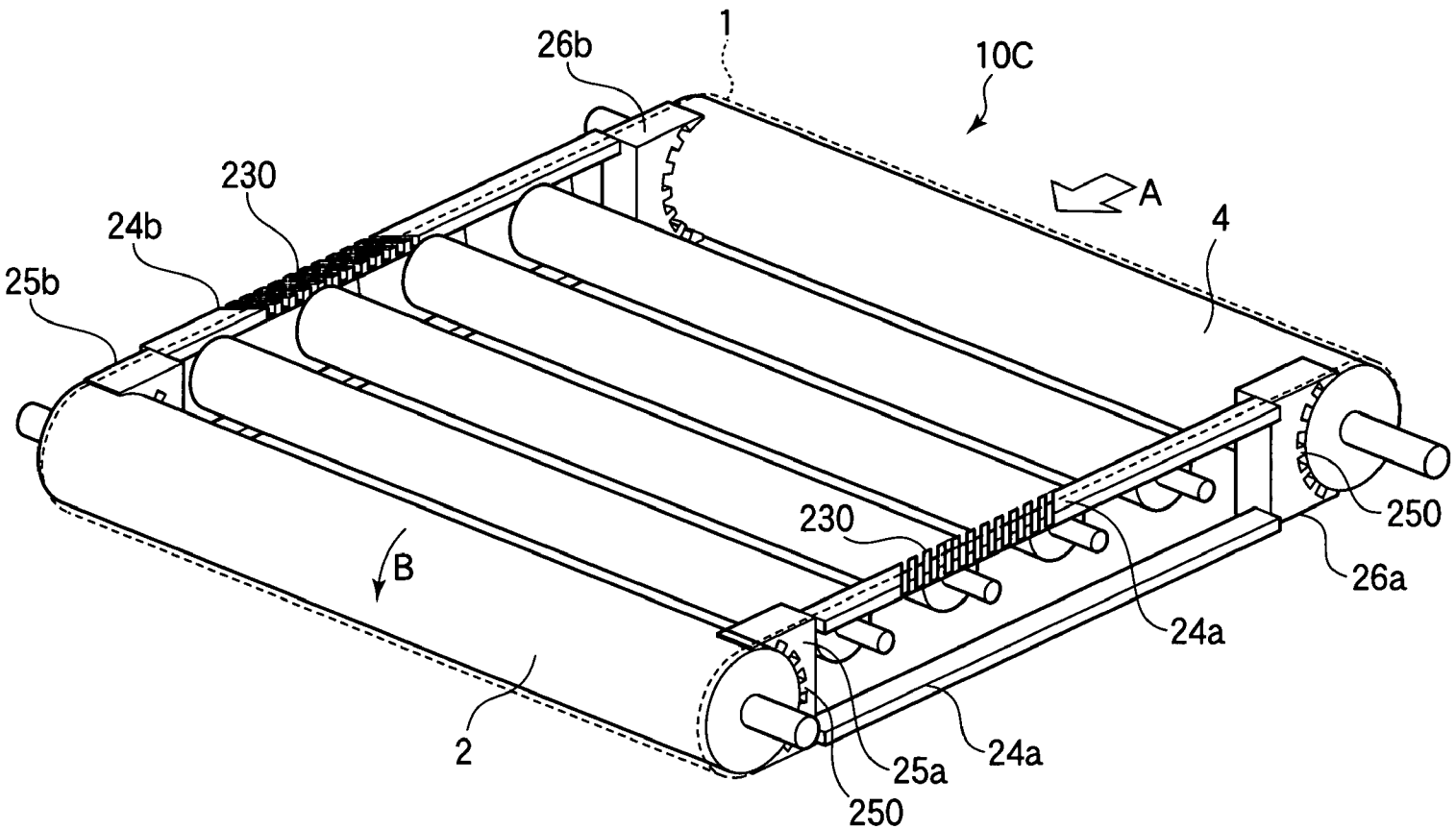
FIG. 9 is a perspective view of the belt device according to the fourth embodiment of the present invention.

FIG. 9 is a perspective view of a belt device 10C according to the fourth embodiment of the present invention. The difference between the fourth embodiment and the third embodiment is in the structure of the seal members. The other elements in the fourth embodiment are the same as those in the third embodiment. The belt device 10C of the fourth embodiment is used in the image forming apparatus (FIG. 1) described in the first embodiment. In FIG. 9, the belt frame 3 is omitted.

The seal members 24*a* and 24*b* are beltlike members made of resilient material such as NBR (nitrile-butadiene rubber). The seal members 24*a* and 24*b* are straightly extends from the vicinity of the drive roller 2 to the vicinity of the tension roller 4. The seal members 24*a* and 24*b* have ribs 230 formed on the surfaces facing the endless belt 1. The ribs 230 are evenly spaced in the circumferential direction of the seal members 24*a* and 24*b*. A pair of seal members 24*a* are provided on the top and bottom surfaces of the belt frame 3. A pair of seal members 24*b* are provided on the top and bottom surfaces of the belt frame 3.

Figure 10A:
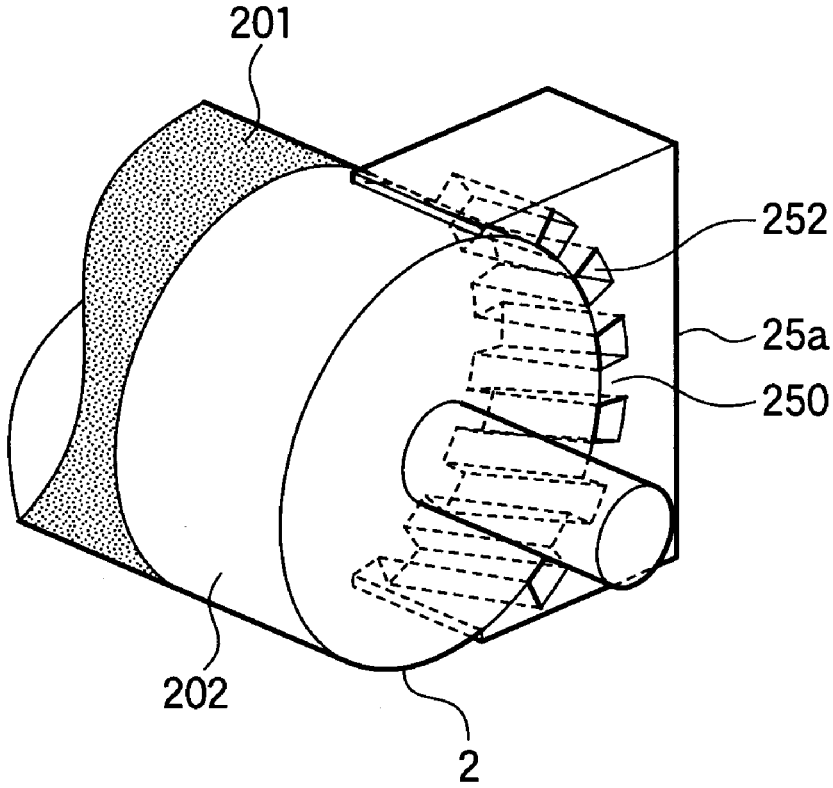
FIGS. 10A and 10B are enlarged views of a seal member of the belt device according to the fourth embodiment of the present invention.
Figure 10B:
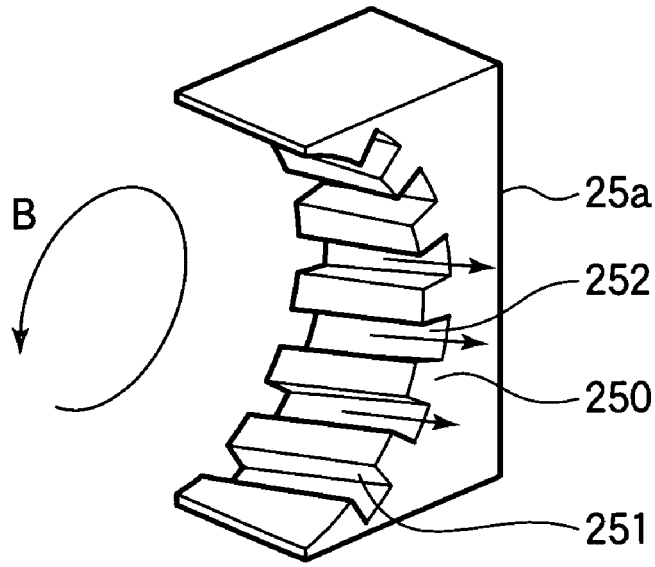

Moreover, seal members 25*a* and 25*b* are disposed on both sides of the endless belt 1 in the width direction, and contact the outer circumferential surface of the drive roller 2. FIG. 10A is a perspective view of illustrating how the seal member 25*a* contacts the drive roller 2. FIG. 10B is a perspective view illustrating the shape of the seal member 25*a*. As shown in FIG. 10A, the seal member 25*a* has a plurality of ribs 250 arranged along a concave cylindrical surface corresponding to halfway around the outer circumferential surface of the drive roller 2. As shown in FIG. 10B, each rib 250 has a rectangular cross section. Grooves 252 are formed between the adjacent ribs 250. Each groove 252 has, for example, a rectangular cross section. The ribs 250 contact the outer circumferential surface of the rotating drive roller 2, so that the toner is scraped from the drive roller 2 by a rear end surface 251 (in the rotating direction B) of each rib 250.

The extending direction of each rib 250 (and each groove 252) is inclined with respect to the rotating direction B (i.e., the circumferential direction) of the drive roller 2. The rib 250 is so inclined that the outer side (i.e., the right side in FIG. 10A) of the rib 250 in the width direction of the endless belt 1 positions more to the front in the rotating direction B than the inner side of the rib 250. With such an inclination, the toner can be ejected outward in the width direction of the endless belt 1.

The angle between the extending direction of the rib 250 and the rotating direction B of the drive roller 2 is preferably 45 degrees. However, if the angle ranges from 30 to 60 degrees, the toner can be efficiently ejected outward. Although the seal member 25*b* is omitted in FIG. 10A, the seal member 25*b* has the same ribs as the ribs 250 of the seal member 25*a*. The rib 250 of the seal member 25*b* and the rib 250 of the seal member 25*a* are symmetrical to each other with respect to a center line (extending in the front-rear direction) of the endless belt 1 so that the toner is ejected outward in the width direction.

The drive roller 2 includes a metal roller having a surface 202 on which a rubber surface layer (or, a coating layer including ceramic powder) is formed, as was described in the first embodiment. On both end portions of the drive roller 2 that contact the seal members 25*a* and 25*b*, the rubber surface layers or the coating layers (denoted by numeral 201) are stripped, so that the seal members 25*a* and 25*b* directly contact the surface 202 of the metal roller.

As shown in FIG. 9, seal members 26*a* and 26*b* contact the outer circumferential surface of the tension roller 4 on both sides of the endless belt 1. The seal members 26*a* and 26*b* have the same structures as those of the seal members 25*a* and 25*b*, and have the above described ribs 250. The ribs 250 of the seal members 26*a* and 26*b* are so inclined that the toner is ejected outward in the width direction of the endless belt 1 when the tension roller 4 rotates. The seal members 25*a*, 25*b*, 26*a* and 26*b* are formed by resilient material such as NBR.

Figure 11:
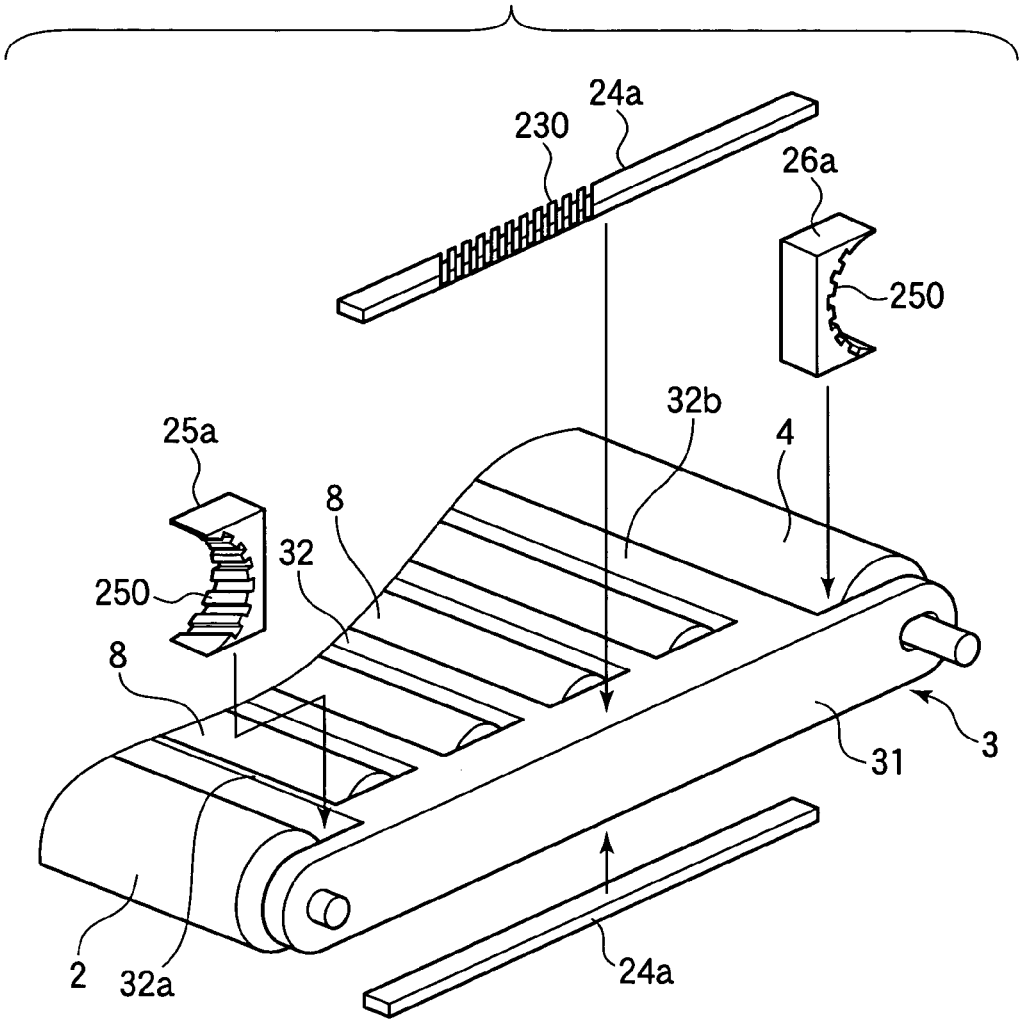
FIG. 11 is a perspective view illustrating mounting positions of the respective seal members of the belt device according to the fourth embodiment of the present invention.

FIG. 11 is a perspective view illustrating the mounting positions of the seal members 24*a*, 25*a* and 26*a*. As was described in the first embodiment, the belt frame 3 has two extending portions 31 (only one of which is shown in FIG. 11) and the partitions 32 laterally extending between two extending portions 31 to divide the space between the extending portions 31. The extending portions 31 project frontward from the frontmost partition 32*a*, and the drive roller 2 is mounted on the frontward projecting portions of the extending portions 31. The extending portions 31 project rearward from the rearmost partition 32*b*, and the tension roller 4 is mounted on the rear projecting portions of the extending portions 31. A pair of seal members 24*a* are fixed to the upper and lower surfaces of each extending portions 31 of the belt frame 3. The seal member 25*a* is disposed between the drive roller 2 and the frontmost partition 32*a*. The seal member 26*a* is disposed between the tension roller 4 and the rearmost partition 32*b*. Although the seal members 24*b*, 25*b* and 26*b* are omitted in FIG. 11, the seal members 24*b*, 25*b* and 26*b* are respectively disposed on positions which are laterally symmetrical to the seal members 24*a*, 25*a* and 26*a*.

In the fourth embodiment, the seal members 24*a* and 24*b* prevent the entry of the toner through the gap between the endless belt 1 and the belt frame 3. Moreover, the seal members 25*a* and 25*b* prevent the entry of the toner through the gap around the drive roller 2. The seal members 26*a* and 26*b* prevent the entry of the toner through the gap around the tension roller 4.

Additionally, the ribs 230 and 250 of the seal members 24*a*, 24*b*, 25*a* and 25*b* scrape the toner from the endless belt 1 or the drive roller 2, and therefore it is possible to prevent the toner from being caught between the endless belt 1 and the drive roller 2. The ribs 250 of the seal members 26*a* and 26*b* scrape the toner from the tension roller 4, and therefore it is possible to prevent the toner from being caught between the endless belt 1 and the tension roller 4. Thus, it is possible to prevent the toner that has adheres to the tension roller 4 from being caught between the endless belt 1 and the drive roller 2 via the inner circumferential surface of the endless belt 1. Accordingly, it is ensured that the decrease in the friction force due to the toner caught between the drive roller 2 and the endless belt 1 can be prevented, and therefore it is ensured that the degradation of the image quality due to the shifting of the transferring positions can be prevented.

In the fourth embodiment, the seal members 25*a*, 25*b*, 26*a* and 26*b* directly contact the drive roller 2 and the tension roller 4 both of which are solid bodies. Therefore, the contact pressure becomes more stable, compared with the case in which the seal members contacts the resilient endless belt 1 over the whole circumference of the endless belt 1 as in the second embodiment. Thus, it is possible to enhance the effect of preventing the entry of the toner. Further, since the stable contact pressure is obtained, the effect of ejecting the toner by the ribs 250 of the seal members 25*a*, 25*b*, 26*a* and 26*b* is enhanced, and therefore it is ensured that the toner is prevented from being caught between the drive roller 2 and the endless belt 1 can be prevented.

In the fourth embodiment, the seal members are disposed on both sides of the endless belt 1 in the width direction. However, if the toner falls on only one side of the endless belt 1 in the width direction, it is possible to provide one seal member on one side of the endless belt 1.

Fifth Embodiment

Figure 12:
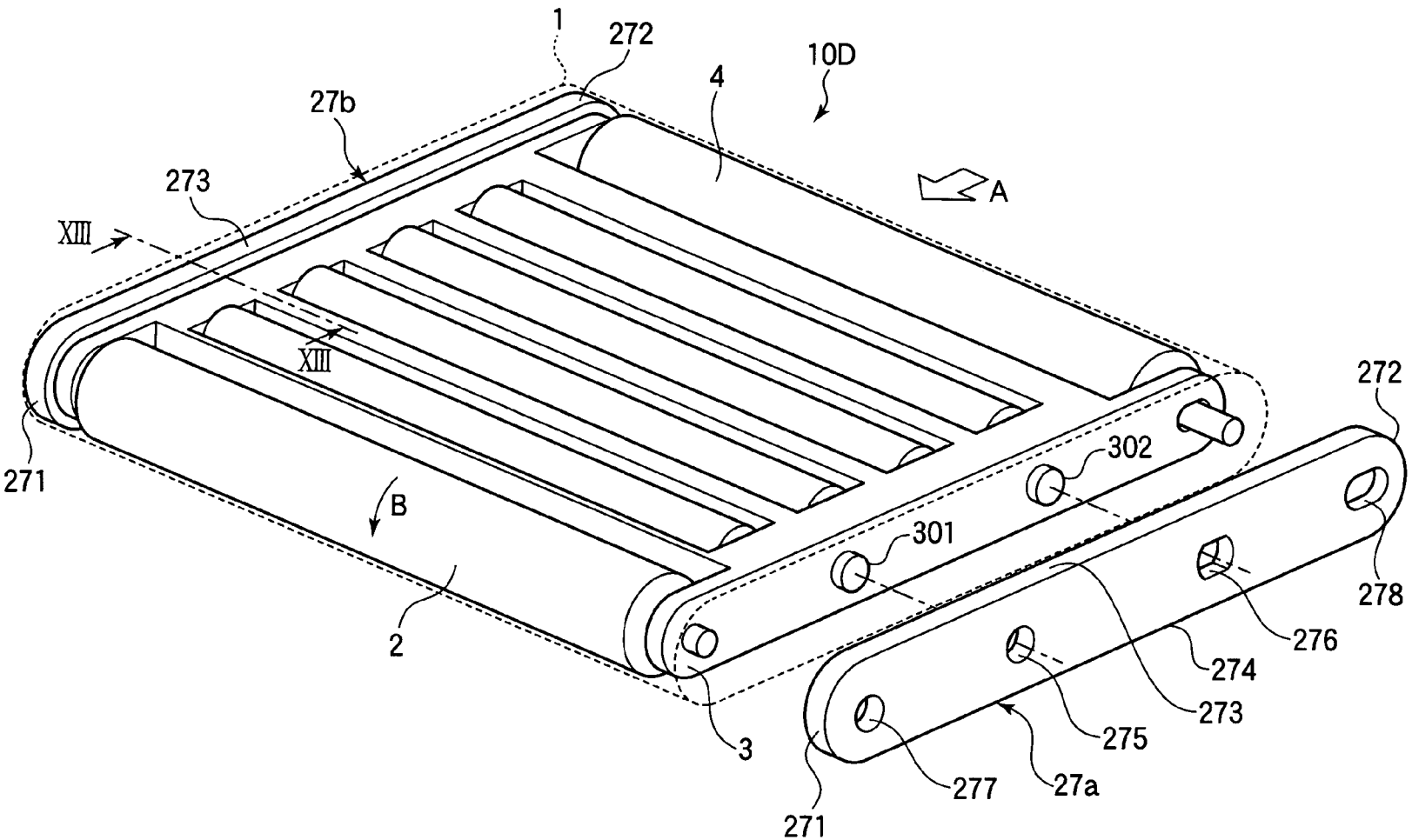
FIG. 12 is a perspective view of the belt device according to the fifth embodiment of the present invention.
Figure 13:
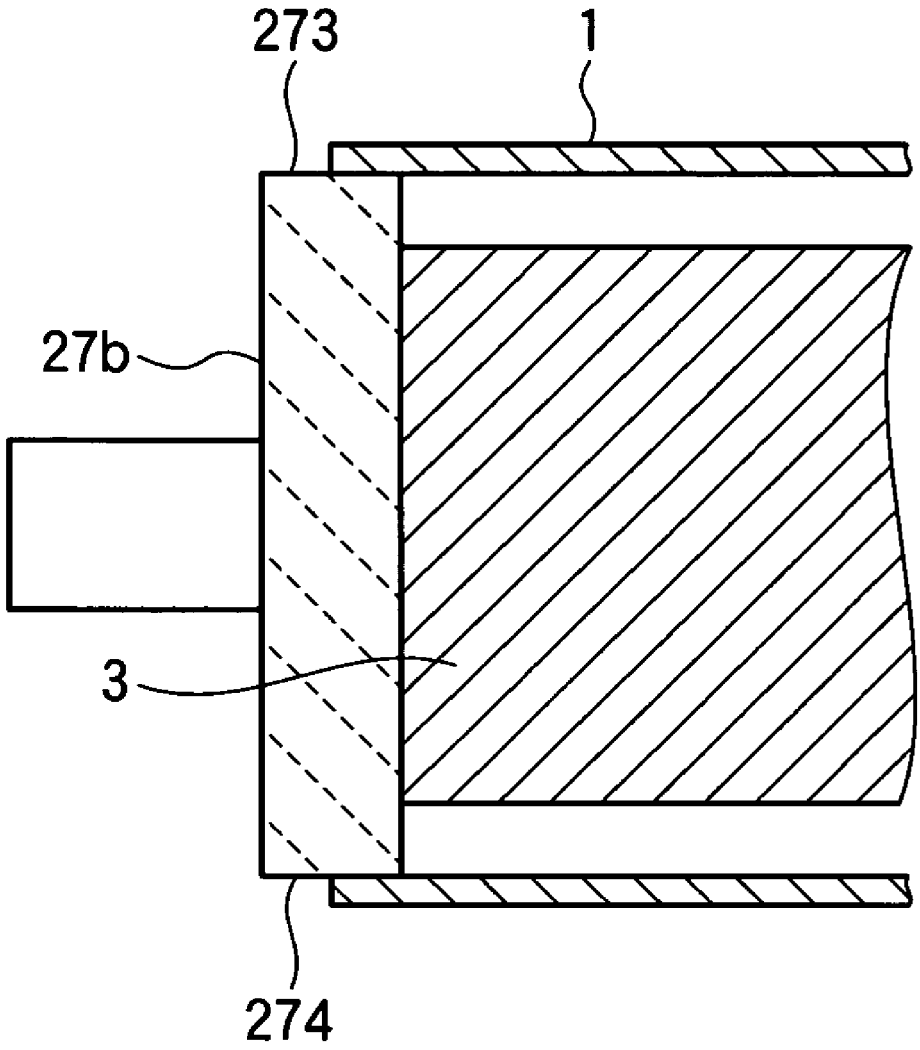
FIG. 13 is a sectional view of the belt device according to the fifth embodiment of the present invention taken along line XIII-XIII in FIG. 12.

FIG. 12 is a perspective view of a belt device 10D according to the fifth embodiment of the present invention. FIG. 13 is a sectional view taken along line XIII-XIII. The difference between the fifth embodiment and the first embodiment is in the structure of the seal members. The other elements in the fifth embodiment are the same as those in the first embodiment. The belt device 10D of the fifth embodiment can be used in the image forming apparatus (FIG. 1) described in the first embodiment.

As shown in FIG. 12, seal members 27*a* and 27*b* of the fifth embodiment are fixed to the both sides of the belt frame 3 in the width direction of the endless belt 1. The seal members 27*a* and 27*b* are made of resilient material such as urethane foam. Each of the cover members 27*a* and 27*b* includes an elongated plate member (elongated in the front-rear direction) with both ends in the longitudinal direction being in the shape of semicircles. The front and rear semi-circular surfaces 271 and 272 of the seal members 27*a* and 27*b* contact the inner circumferential surfaces of the curved portions of the endless belt 1. The upper and lower surfaces 273 and 274 that straightly extend in the longitudinal direction of the seal members 27*a* and 27*b* contact the inner circumferential surfaces of the straightly extending portions of the endless belt 1. With such an arrangement, the whole circumferences of the seal members 27*a* and 27*b* contact the inner circumferential surface of the endless belt 1.

The belt frame 3 has bosses 301 and 302 protruded from the side facing the seal member 27*a*, for supporting the seal member 27*a*. The seal member 27*a* has engaging holes 275 and 276 that engage the bosses 301 and 302. Further, the seal member 27*a* has through holes 277 and 278 through which the shafts of the drive roller 2 and the tension roller 4 are inserted. The belt frame 3 has not shown bosses on the side facing the seal member 27*b*, which are the same as the bosses 301 and 302. The seal member 27*b* has not shown engaging holes which are the same as the engaging holes 275 and 276, and not shown through holes which are the same as the through holes 277 and 278.

In the fifth embodiment, when the drive roller 2 rotates, the endless belt 1 moves in sliding contact with the seal members 27*a* and 27*b*. Even when the toner falls from the accommodating portion 16, it is ensured that the entry of the toner into the inner region of the endless belt 1 can be prevented, because the seal member 27*a* and 27*b* close the inner region of the endless belt 1. Accordingly, it is ensured that the decrease in the friction force due to the toner caught between the drive roller 2 and the endless belt 1 can be prevented, and therefore it is ensured that the degradation of the image quality due to the shifting of the transferring positions can be prevented.

In the above described second embodiment, the endless belt 1 must be wound around the drive roller 2 and the tension roller 4 after the seal members 22*a* and 22*b* are attached to the belt frame 3. However, in this fifth embodiment, the seal members 27*a* and 27*b* can be attached to the belt frame 3 after the endless belt 1 is wound around the drive roller 2 and the tension roller 4. Thus, the assembling of the belt device 10D can be simplified. Further, if the seal members 27*a* and 27*b* are stained, the seal members 27*a* and 27*b* can easily be replaced. Thus, the maintainability can be improved, and the lifetime of the belt device 10D can be lengthened.

In the fifth embodiment, the seal members 27*a* and 27*b* are disposed on both sides of the endless belt 1 in the width direction. However, if the toner falls on only one side of the endless belt 1 in the width direction, it is possible to provide one seal member on one side of the endless belt 1.

Further, it is also possible that the seal members 27*a* and 27*b* have ribs as described in the third embodiment on the surfaces that contact the endless belt 1 so as to eject the toner outward in the width direction. Moreover, the seal members 27*a* and 27*b* can be constructed as one member.

Sixth Embodiment

Figure 14:
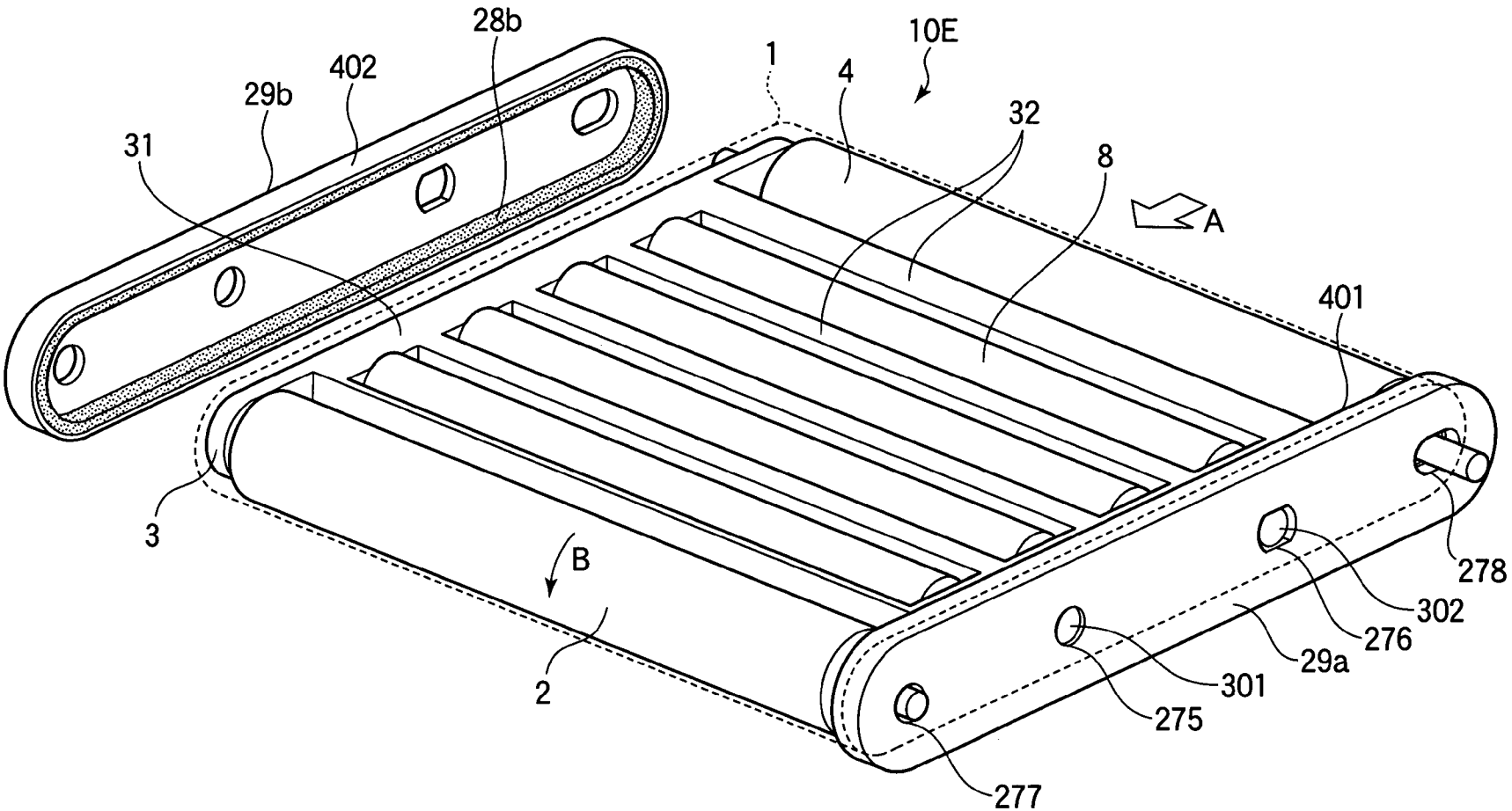
FIG. 14 is a perspective view of the belt device according to the sixth embodiment of the present invention.
Figure 15:
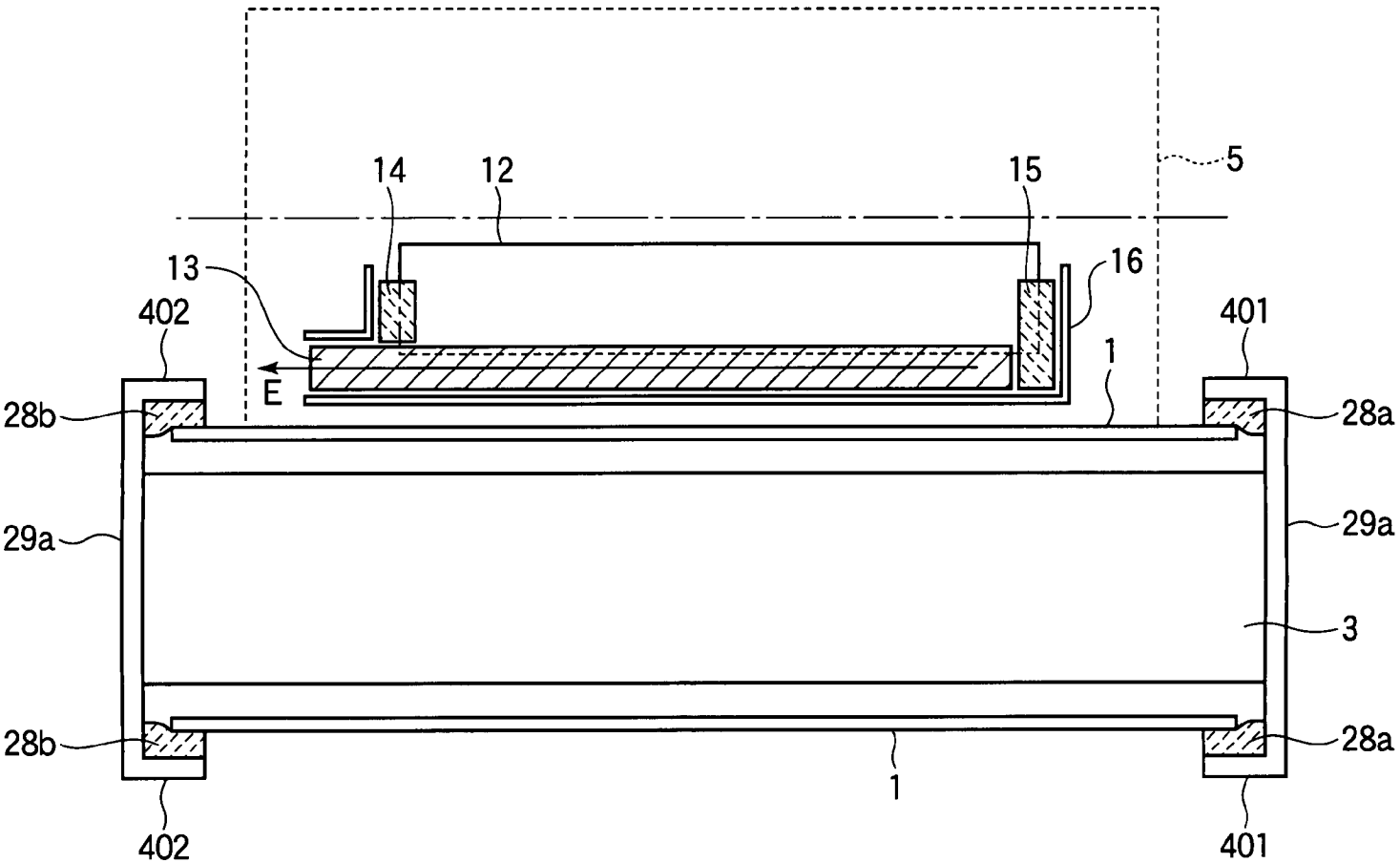
FIG. 15 is a sectional view of the belt device according to the sixth embodiment of the present invention.

FIG. 14 is a perspective view of a belt device 10E according to the sixth embodiment of the present invention. FIG. 15 is a sectional view of the belt device 10E according to the sixth embodiment, corresponding to the sectional view taken along line II-II of FIG. 1. The difference between the sixth embodiment and the fifth embodiment is in the structure of the seal members. The other elements in the sixth embodiment are the same as those in the fifth embodiment. The belt device 10E of the sixth embodiment can be used in the image forming apparatus (FIG. 1) described in the first embodiment.

As shown in FIG. 14, seal members 28*a* and 28*b* (the seal member 28*a* is omitted in FIG. 14) of the sixth embodiment are configured to contact the outer circumferential surface of the endless belt 1 over the whole circumference of the endless belt 1. As shown in FIG. 15, the seal members 28*a* and 28*b* are fixed to the inner surfaces of cover members 29*a* and 29*b* attached to the both sides of the belt frame 3 in the width direction. The seal members 28*a* and 28*b* and the cover members 29*a* and 29*b* are disposed on the outside of the photosensitive body 5 in the width direction of the endless belt 1, so as not to interfere with the transferring of the toner image from the photosensitive body 5 to the not shown recording medium.

Each of the cover members 29*a* and 29*b* includes an elongated plate member with both ends in the longitudinal direction being in the shape of semicircles. Ribs 401 and 402 are formed along the circumference of the cover members 29*a* and 29*b*. The gap between the rib 401 and the belt frame 3 is sealed by a seal member 28*a*, and the gap between the rib 402 and the belt frame 3 is sealed by a seal member 28*b*. The bosses 301 and 302, both of which are described in the fifth embodiment, are protruded from the side of the belt frame 3 facing the seal member 28*a*. The bosses (not shown) which are the same as the bosses 301 and 302 are protruded from the side of the belt frame 3 facing the seal member 28*b*. The cover members 29*a* and 29*b* have engaging holes 275 and 276 which the bosses 301 and 302 engage and through holes 277 and 278 through which the shafts of the drive roller 2 and the tension roller 4 are inserted.

In the sixth embodiment, when the drive roller 2 rotates, the endless belt 1 moves in sliding contact with the seal members 28*a* and 28*b* along the circumference of the endless belt 1. The entry of the toner into the inner region of the endless belt 1 can be prevented in all direction. Further, since the seal member 28*a* and 28*b* contact the endless belt 1 from outside, the effect of preventing the entry of the toner is maintained even when a flare or the like occurs on the endless belt 1. As a result, it is possible to prevent the decrease in the friction force between the endless belt 1 and the drive roller 2 due to the toner caught between the drive roller 2 and the endless belt 1. Thus, it is possible to prevent the degradation of the image quality due to the shifting of the-transferring positions.

Moreover, after the seal member 28*a* is fixed to the cover member 29*a* to form one unit, and the seal member 28*b* is fixed to the cover member 29*b* to form another unit, the units can be attached to the belt frame 3. Thus, the assembling of the belt device 10E can be simplified. Further, if the seal members 28*a* and 28*b* are stained, the seal members 28*a* and 28*b* can easily be replaced together with the cover members 29*a* and 29*b*. Thus, the maintainability can be improved, and the lifetime of the belt device 10E can be lengthened.

In the sixth embodiment, the seal members 28*a* and 28*b* are disposed on both sides of the endless belt 1 in the width direction. However, if the toner falls on only one side of the endless belt 1 in the width direction, it is possible to provide one seal member on one side of the endless belt 1. Moreover, the seal members 28*a* and 28*b* can be constructed as one member.

Seventh Embodiment

Figure 16:
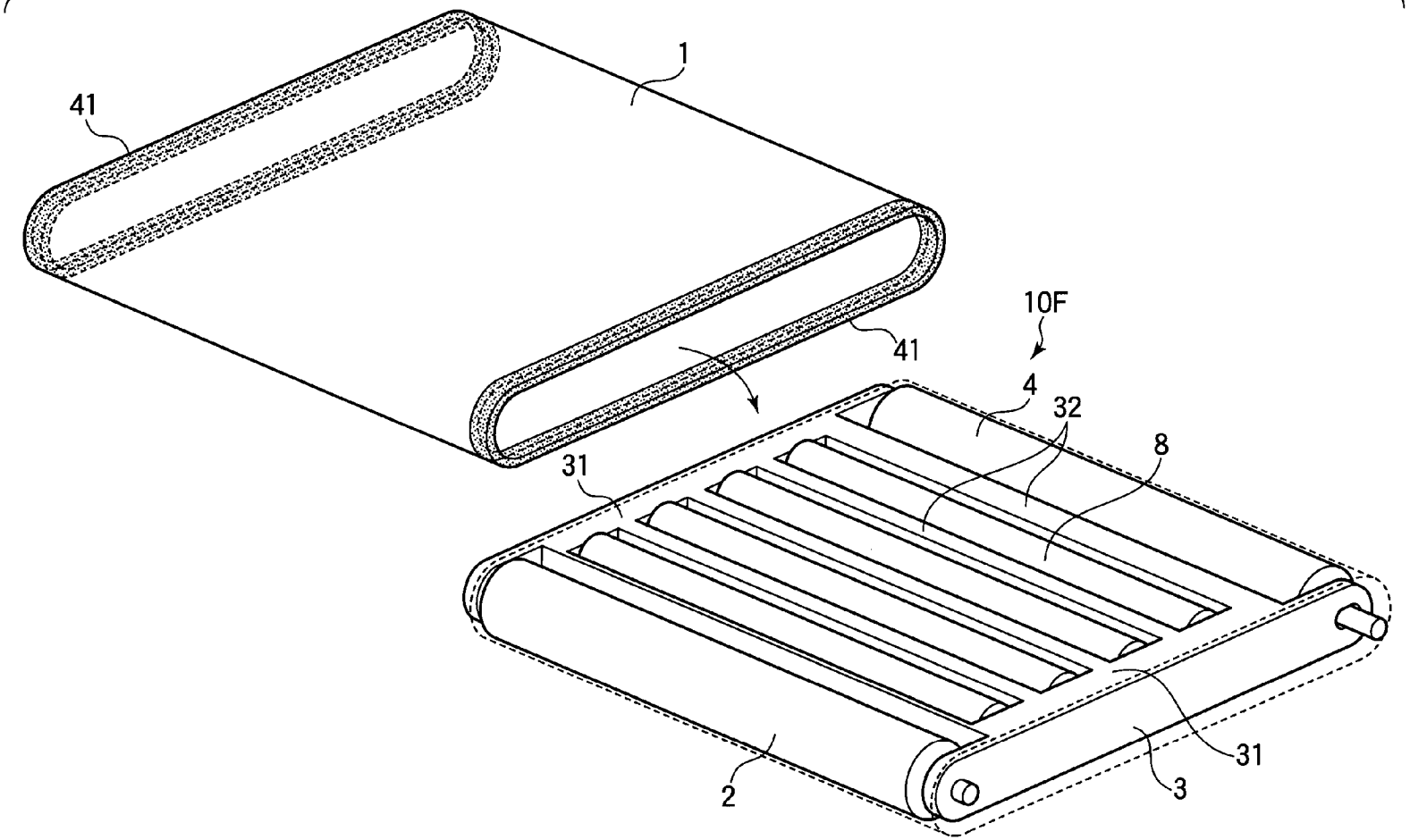
FIG. 16 is a perspective view of the belt device according to the seventh embodiment of the present invention.
Figure 17:
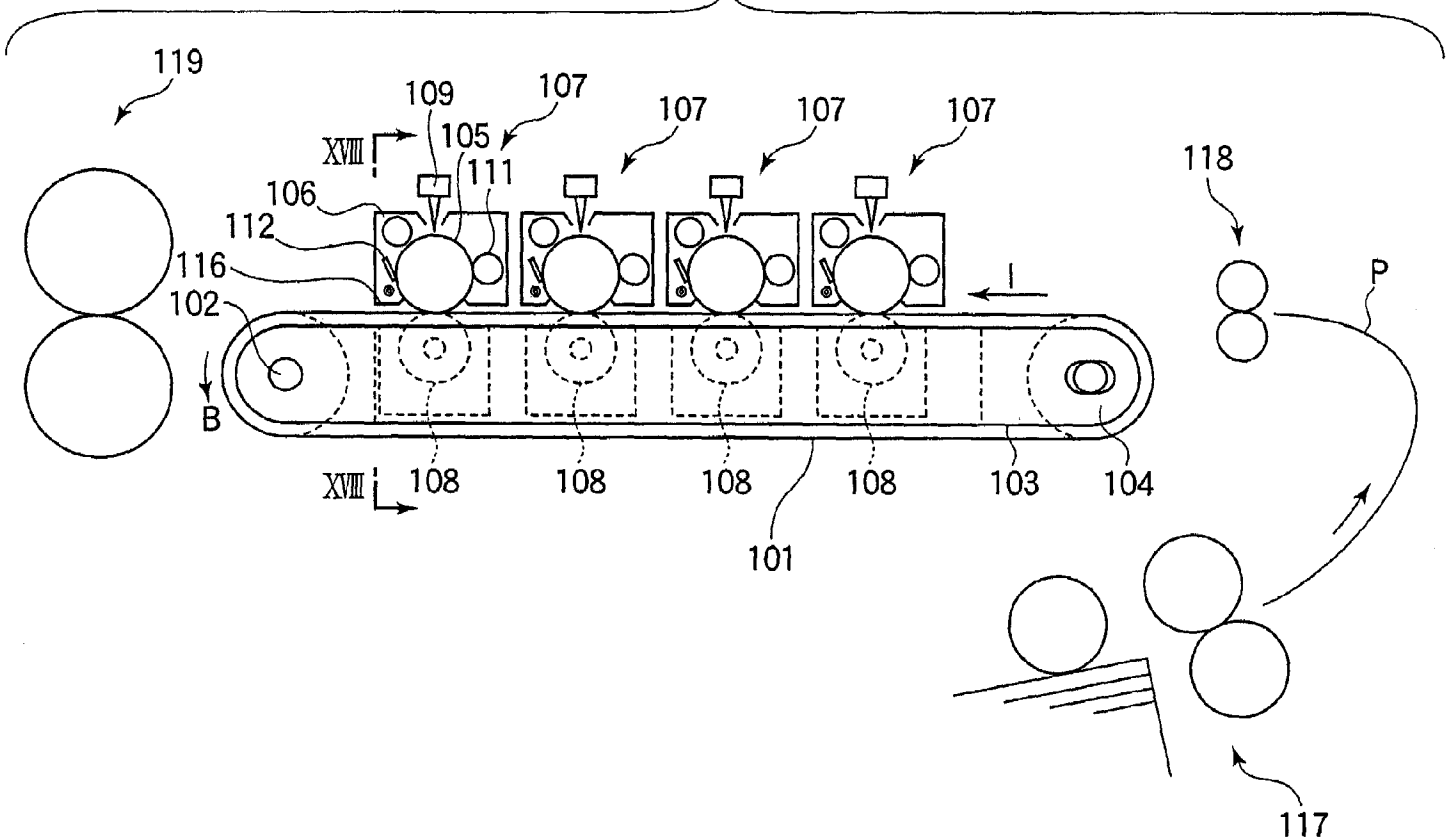
CONVENTIONAL ART FIG.17
FIG. 17 shows an example of the basic structure of a conventional image forming apparatus.
Figure 18:
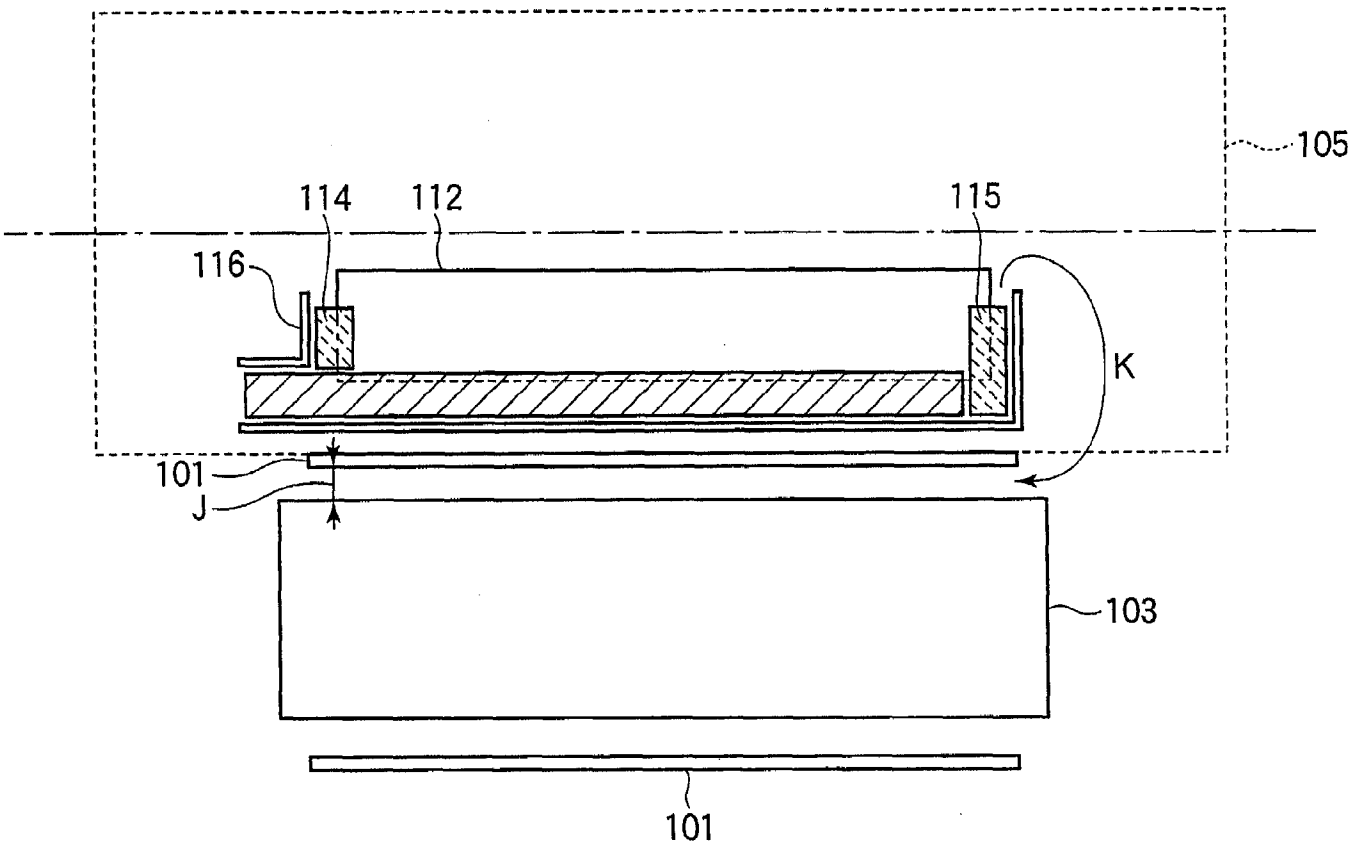
FIG.18 CONVENTIONAL ART
FIG. 18 is a sectional view of the image forming apparatus shown in FIG. 17 taken along line XVIII-XVIII in FIG. 17.
Figure 19:
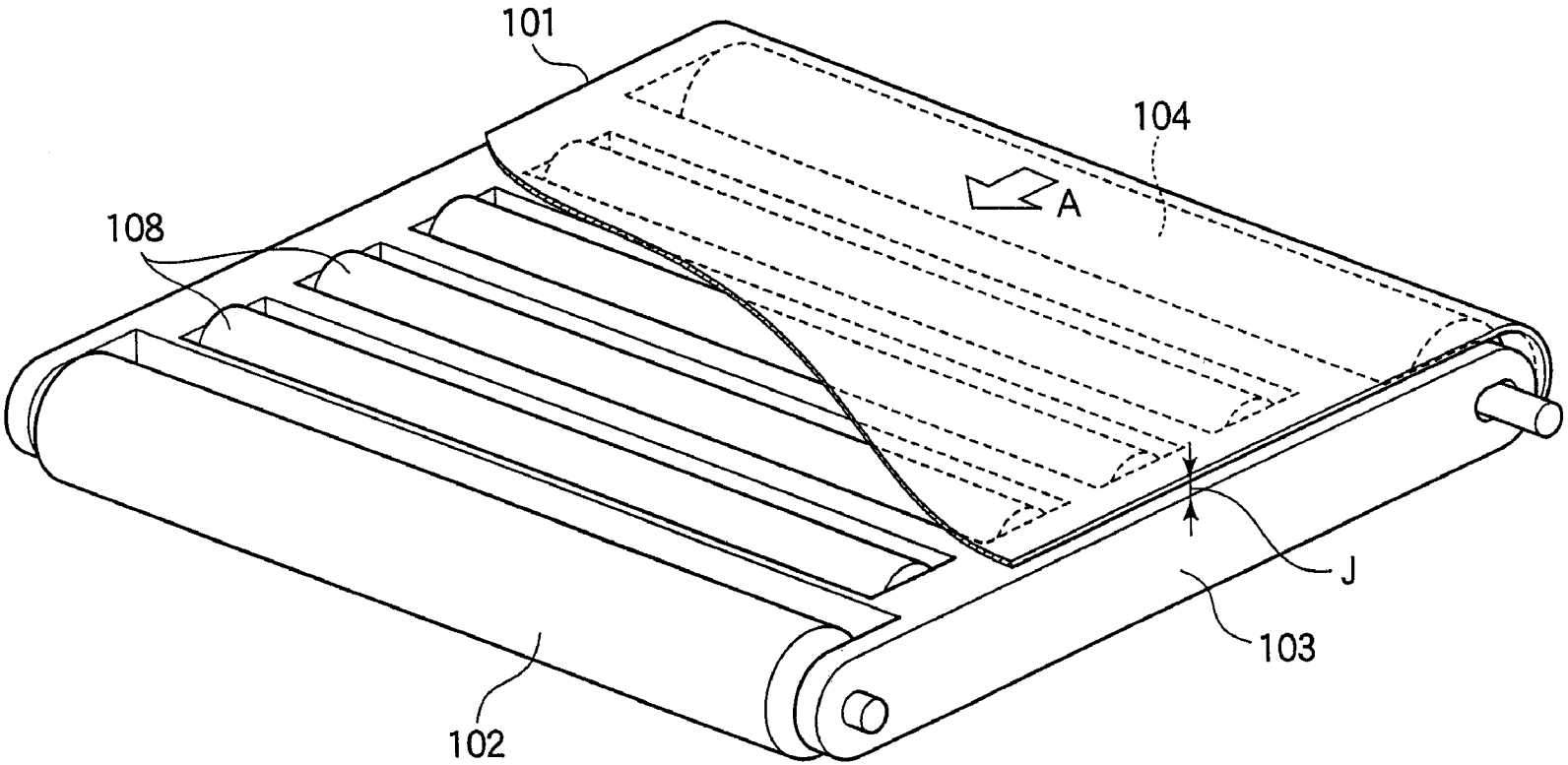
FIG.19 CONVENTIONAL ART
FIG. 19 is a perspective view of the image forming apparatus shown in FIG. 17.

FIG. 16 is a perspective view of a belt device 10F according to the seventh embodiment of the present invention. The difference between the seventh embodiment and the first embodiment is in the structure of the seal members. The other elements in the seventh embodiment are the same as those in the first embodiment. The belt device 10F of the seventh embodiment can be used in the image forming apparatus (FIG. 1) described in the first embodiment.

As shown in FIG. 16, the seal members 41*a* and 41*b* of the seventh embodiment are not provided on the belt frame 3, but provided on the inner circumferential surface of the endless belt 1. The seal members 41*a* and 41*b* are made of resilient material such as urethane foam. The seal members 41*a* and 41*b* extend along the sides (in the width direction) of the endless belt 1 over the whole circumference of the endless belt 1. When the endless belt 1 is attached to the drive roller 2 and the tension roller 4, the seal members 41*a* and 41*b* contact the upper surface of the extending portions 31 of the belt frame 3, so as to seal between the endless belt 1 and the belt frame 3.

When the drive roller 2 rotates and the endless belt 1 moves, the seal members 41*a* and 41*b* also move in sliding contact with the outer circumferential surface of the extending portion 31 of the belt frame 3 over the whole circumference of the endless belt 1. The seal members 41*a* and 41*b* prevent the entry of the toner into the inner region of the endless belt 1 in all direction. Further, since the resilient seal member 41*a* and 41*b* are fixed to the endless belt 1, the effect of preventing the entry of the toner is maintained even when a flare or the like occurs on the side (edge) of the endless belt 1. As a result, it is possible to prevent the decrease in the friction force between the endless belt 1 and the drive roller 2 due to the toner caught between the drive roller 2 and the endless belt 1. Further, it is possible to prevent the degradation of the image quality due to the shifting of the transferring positions.

Moreover, the seal members 41*a* and 41*b* are integral with the endless belt 1, and therefore the seal members 41*a* and 41*b* can easily be disposed on positions where the seal members 41 and 41*b* seal between the endless belt 1 and the belt frame 3, by mounting the endless belt 1 to the belt frame 3.

In the seventh embodiment, the seal members 41*a* and 41*b* are disposed on both sides of the endless belt 1 in the width direction. However, if the toner falls on only one side of the endless belt 1 in the width direction, it is possible to provide one seal member on one side of the endless belt 1. Moreover, it is also possible to form ribs as described in the third embodiment to inner circumferential surfaces (i.e., the belt frame 3 side) of the seal members 41*a* and 41*b*, so that the toner is ejected outward in the width direction of the endless belt 1.

In the first through sixth embodiments, it is also possible to apply low friction coating such as PTFE (polytetrafluoroethylene) on surfaces of the endless belt 1 and the seal members, in order to improve abrasive resistance and slidability between the endless belt 1 and the seal members. Similarly, in the seventh embodiment, it is also possible to apply the low friction coating on the surfaces of the seal members and the belt frame 3, in order to improve abrasive resistance and slidability between the seal members 41 and the belt frame 3. The application of the friction coating is not so effective in the case where the seal members are made of material (such as sponge) having low elasticity, but effective in the case where the seal members are made of material (such as rubber) having high elasticity.

Alternatively, it is possible that the seal members are made of low friction material mainly including fluorine, in order to improve abrasive resistance and slidability without applying the low friction coating on the seal members or the like. With such an arrangement, there is low possibility that the flaking of coating layer (which may becomes foreign material) of the seal members.

Although the first through seventh embodiments are described with reference to the toner, the present invention can be applied to foreign material other than the toner. Further, the endless belt 1 can be used as an intermediate transfer belt that bears a toner image and transfers the toner image to the recording medium or the like.

The present invention is applicable to the image forming apparatus (for example, a copier, a facsimile or a printer) that forms an image by electrophotography.

While the preferred embodiments of the present invention have been illustrated in detail, it should be apparent that modifications and improvements may be made to the invention without departing from the spirit and scope of the invention as described in the following claims.

What is claimed is:

1. A belt device comprising:

an endless belt used to convey a recording medium or to bear a toner image;

a plurality of rollers around which said endless belt is wound;

a frame that supports said plurality of rollers; and a foreign material entry preventing member disposed on at least one side of said endless belt in a width direction of said endless belt, said foreign material entry preventing member preventing the entry of foreign material into a region surrounded by said endless belt, wherein said foreign material entry preventing member contacts an inner circumferential surface of said endless belt over the whole circumference of said endless belt on at least one side of said endless belt in said width direction so as to seal between said endless belt and said frame.

2. The belt device according to claim 1, wherein said foreign material entry preventing member is made of resilient material.

3. An image forming apparatus using said belt device according to claim 1.

4. The belt device according to claim 1, wherein said foreign material entry preventing member has a groove on a surface that contacts said endless belt, and said groove gnides said foreign material so that said foreign material is ejected outward in said width direction.

5. The belt device according to claim 4, wherein said foreign material entry preventing member is made of resilient material.

6. The belt device according to claim 1, wherein said foreign material entry preventing member is detachably attached to at least one side of said frame in said width direction.

7. The belt device according to claim 1, wherein said foreign material entry preventing member is provided on an inner circumferential surface of said endless belt.

8. The belt device according to claim 7, wherein said foreign material entry preventing member extends over the whole circumference of said endless belt on at least one side of said endless belt in said width direction.

9. A belt device comprising, an endless belt used to convey a recording medium or to bear a toner image;

a plurality of rollers around which said endless belt is wound;

a frame that supports said plurality of rollers, and a foreign material entry preventing member made of resilient material, said foreign material entry preventing member being disposed between two rollers of said plurality of rollers on at least one side of said endless belt in a width direction of said endless belt to prevent the entry of foreign material into a region surrounded by said endless belt;

wherein said foreign material entry preventing member contacts an inner circumferential surface of said endless belt and extends from the vicinity of one roller to the vicinity of another roller to seal between said endless belt and said frame.

10. An image forming apparatus using said belt device according to claim 9.

11. A belt device comprising, an endless belt is used to convey a recording medium or to bear a toner image;

a plurality of rollers around which said endless belt is wound; and a foreign material entry preventing member made of resilient material, said foreign material entry preventing member being disposed between two rollers of said plurality of rollers on at least one side of said endless belt in a width direction of said endless belt and extending from the vicinity of one roller to the vicinity of another roller to prevent the entry of foreign material into a region surrounded by said endless belt.

12. An image forming apparatus using said belt device according to claim 11.

13. The belt device according to claim 11, wherein said foreign material entry preventing member contacts an inner circumferential surface of said endless belt.

14. The belt device according to claim 11, further comprising a frame that supports said plurality of rollers, wherein said foreign material entry preventing member seals between said endless belt and said frame.

15. The belt device according to claim 11, wherein said foreign material entry preventing member contacts an inner circumferential surface of said endless belt over the whole circumference of said endless belt on at least one side of said endless belt in said width direction.

* * * * *